US012798828B2

(12) United States Patent
Lee et al.

(10) Patent No.: US 12,798,828 B2
(45) Date of Patent: Nov. 17, 2026

(54) PACKAGE BOX ASSEMBLY

(71) Applicant: Samsung Electronics Co., Ltd., Suwon-si (KR)

(72) Inventors: Ohhee Lee, Suwon-si (KR); Byounguk Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 18/928,768

(22) Filed: Oct. 28, 2024

(65) Prior Publication Data

US 2025/0051054 A1 Feb. 13, 2025

Related U.S. Application Data

(63) Continuation of application No. PCT/KR2023/006361, filed on May 10, 2023.

(30) Foreign Application Priority Data

May 30, 2022 (KR) ..... 10-2022-0065807

(51) Int. Cl.
*B65D 6/00* (2006.01)
*B65D 25/10* (2006.01)
(Continued)

(52) U.S. Cl.
CPC ..... *B65D 13/04* (2013.01); *B65D 25/10* (2013.01); *B65D 43/162* (2013.01); *B65D 65/40* (2013.01); *B65D 65/466* (2013.01)

(58) Field of Classification Search
CPC ..... B65D 13/04; B65D 25/10; B65D 43/162; B65D 2585/6835; B65D 81/133;
(Continued)

(56) References Cited

U.S. PATENT DOCUMENTS 6,484,931 B1 11/2002 Hoefte
9,701,450 B1 * 7/2017 Elston ..... B65D 43/169
(Continued)

FOREIGN PATENT DOCUMENTS

EP 1584565 A1 10/2005
JP H0672430 A 3/1994
(Continued)

OTHER PUBLICATIONS

International Search Report for PCT/KR2023/006361 mailed Aug. 2, 2023, 4 pages.
(Continued)

*Primary Examiner* — Rafael A Ortiz
*Assistant Examiner* — Jenine Spicer
(74) *Attorney, Agent, or Firm* — Nixon & Vanderhye, P.C.

(57) ABSTRACT

According to various embodiments, a package box assembly comprises: a first box including a first plate portion and a first accommodation portion formed through a first sidewall extending to a designated height along the edge of the first plate portion; a second box including a second plate portion and a second accommodation portion formed through a second sidewall extending to a designated height along the edge of the second plate portion, the second box configured to beat least partially accommodated in the first accommodation portion; a cover member including a cover configured to cover the rear surface of the package box assembly based on the first box and the second box being coupled; and an engagement structure comprising a hook configured to fix the cover member to the second box, wherein the engagement structure may comprise at least one engagement portion formed on at least a part of the cover member, and at least one engagement groove formed to accommodate the
(Continued)

engagement portion at a corresponding position of the second box.

11 Claims, 26 Drawing Sheets

(51) Int. Cl.
*B65D 43/16* (2006.01)
*B65D 65/40* (2006.01)
*B65D 65/46* (2006.01)

(58) Field of Classification Search
CPC ... B65D 5/60; B65D 5/44; B65D 5/66; B65D 81/027; B65D 85/38; B65D 81/33
See application file for complete search history.

(56) References Cited

U.S. PATENT DOCUMENTS

| | | | | |
|---|---|---|---|---|
| 11,542,056 | B2 | 1/2023 | Jung et al. | |
| 2006/0289665 | A1* | 12/2006 | Yoda | B65D 25/04 237/12.3 R |
| 2015/0060310 | A1* | 3/2015 | Tseng | A45C 11/00 206/45.23 |
| 2020/0086513 | A1* | 3/2020 | Ambielli | A45C 11/32 |
| 2021/0002054 | A1 | 1/2021 | Oh et al. | |
| 2021/0094725 | A1 | 4/2021 | Jung et al. | |
| 2021/0300640 | A1* | 9/2021 | Ludewig | B65D 51/24 |

FOREIGN PATENT DOCUMENTS

| | | | |
|---|---|---|---|
| JP | 7315370 | A | 12/1995 |
| JP | 2002538050 | A | 11/2002 |
| KR | 10-2004-0073759 | A | 8/2004 |
| KR | 20060092383 | A | 8/2006 |
| KR | 200428399 | Y1 | 10/2006 |
| KR | 20080006651 | A | 1/2008 |
| KR | 20080006651 | U | 12/2008 |
| KR | 200456415 | Y1 | 10/2011 |
| KR | 101166835 | B1 | 7/2012 |
| KR | 101167831 | B1 | 7/2012 |
| KR | 20-0466333 | Y1 | 4/2013 |
| KR | 101619084 | B1 | 5/2016 |
| KR | 101838634 | B1 | 3/2018 |
| KR | 20190115673 | A | 10/2019 |
| KR | 20190125014 | A | 11/2019 |

OTHER PUBLICATIONS

Written Opinion of the ISA for PCT/KR2023/006361 mailed Aug. 2, 2023, 6 pages.
Partial Supplementary European Search Report dated Apr. 11, 2025 issued in European Patent Application No. 23816244.0.
Extended European Search Report dated Jul. 2, 2025 issued in European Patent Application No. 23816244.0.

* cited by examiner

PACKAGE BOX ASSEMBLY

CROSS-REFERENCE TO RELATED APPLICATIONS

This application is a continuation of International Application No. PCT/KR2023/006361 designating the U.S., filed on May 10, 2023, in the Korean Intellectual Property Receiving Office and claiming priority to Korean Patent Application No. 10-2022-0065807, filed on May 30, 2022, in the Korean Intellectual Property Office, the disclosures of each of which are incorporated by reference herein in their entireties.

BACKGROUND

Field

The disclosure relates to a package box assembly.

Description of Related Art

Various products such as electronic devices can be distributed after being packaged in a package box. Since package boxes tend to be discarded or rarely used after being opened, they are produced through various manufacturing methods that consider increased resource utilization efficiency through eco-friendly materials and reduced manufacturing costs in terms of the company's Environmental, Social and Governance (ESG) management.

The package box assembly may include a tray for storing an electronic device, a lower box for accommodating the tray, and an upper box combined with the lower box and protecting the electronic device. The lower box may form a tray accommodation space through a plate portion (e.g., a bottom surface) and a sidewall extending along edges of the plate portion to a certain height. The tray has an electronic device accommodation space for accommodating the electronic device. The tray containing the electronic device may be placed in the tray accommodation space of the lower box and then sealed by the upper box.

However, because the typical package box assembly includes the lower box, the tray, and the upper box, it may run counter to the company's ESG management in terms of manufacturing cost and resource efficiency, and may cause problems such as reduced loading efficiency during palletizing due to increased weight or volume.

SUMMARY

Embodiments of the disclosure may provide a package box assembly configured to support a company's ESG management and reduce resource efficiency and/or manufacturing cost.

Embodiments of the disclosure may provide a package box assembly that can help increase loading efficiency through slimming.

However, the problems addressed in the disclosure are not limited to the above-mentioned problems and may be expanded in various ways without departing from the scope of the disclosure.

According to various example embodiments, a package box assembly may include: a first box including a first plate portion and a first accommodation portion formed through a first sidewall extending to a designated height along edges of the first plate portion; a second box including a second plate portion and a second accommodation portion formed through a second sidewall extending to a designated height along edges of the second plate portion, the second box being at least partially accommodated in the first accommodation portion; a cover member including a cover configured to cover a rear surface of the package box assembly based on the first box and the second box being combined; and a hooking structure including a hook configured to fix the cover member to the second box. The hooking structure may include at least one hooking portion formed on at least a part of the cover member, and at least one hooking groove configured to accommodate the hooking portion at a corresponding position of the second box.

According to various example embodiments, a package box assembly may include: a first box including a first plate portion and a first accommodation portion formed through a first sidewall extending to a designated height along edges of the first plate portion; a second box including a second plate portion and a second accommodation portion formed through a second sidewall extending to a designated height along edges of the second plate portion, the second box being at least partially accommodated in the first accommodation portion; and a hooking structure comprising a hook configured to maintain a combined state of the first box and the second box. The hooking structure may include at least one hooking portion formed on the second sidewall of the second box, and at least one hooking step configured to hook the hooking portion at a corresponding position of the first box.

The package box assembly according to various example embodiments of the disclosure comprises a first box (e.g., pulp tray box) that directly accommodates an electronic device and is formed of an eco-friendly pulp material, and a second box (e.g., upper box) combined with the first box, so that it can reduce manufacturing cost and contribute to the ESG management of the company. In addition, the tray box assembly can help increase the loading efficiency when palletizing by having a slimmed-down accommodation structure for the electronic device.

In addition, various effects explicitly or implicitly appreciated through the disclosure may be provided.

BRIEF DESCRIPTION OF THE DRAWINGS

In connection with the description of the drawings, the same or similar reference numerals may be used for the same or similar components. Further, the above and other aspects, features and advantages of certain embodiments of the present disclosure will be more apparent from the following detailed description, taken in conjunction with the accompanying drawings, in which.

DETAILED DESCRIPTION

Hereinafter, various example embodiments of the disclosure will be described in greater detail with reference to the attached drawings. However, a detailed description may be omitted if it may unnecessarily obscure the subject matter of the disclosure.

In describing the disclosure, a first box, a second box, and/or a cover member of a package box assembly may be formed of an environmentally friendly material such as pulp. However, the disclosure is not limited thereto, and the first box, the second box, and/or the cover member of the package box assembly may be formed of at least one of a polymer, a paper material such as a laminate, a metal material, or a fiber material. In addition, in describing the disclosure, an electronic device will be described as a product accommodated in the package box assembly, but it will be apparent to those skilled in the art that the disclosure is not limited thereto.

Figure 1A:
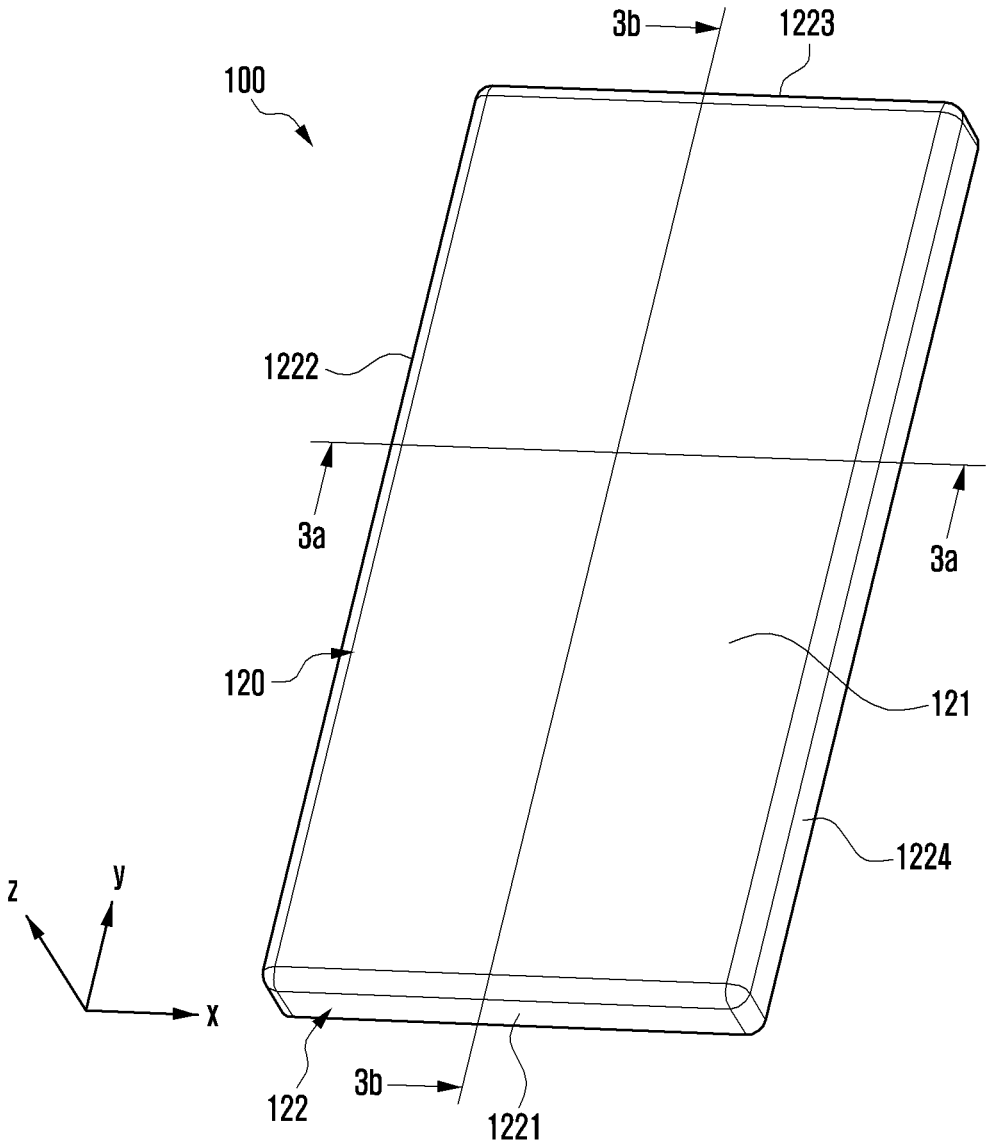
FIG. 1A is a front perspective view of a package box assembly according to various embodiments.
Figure 1B:
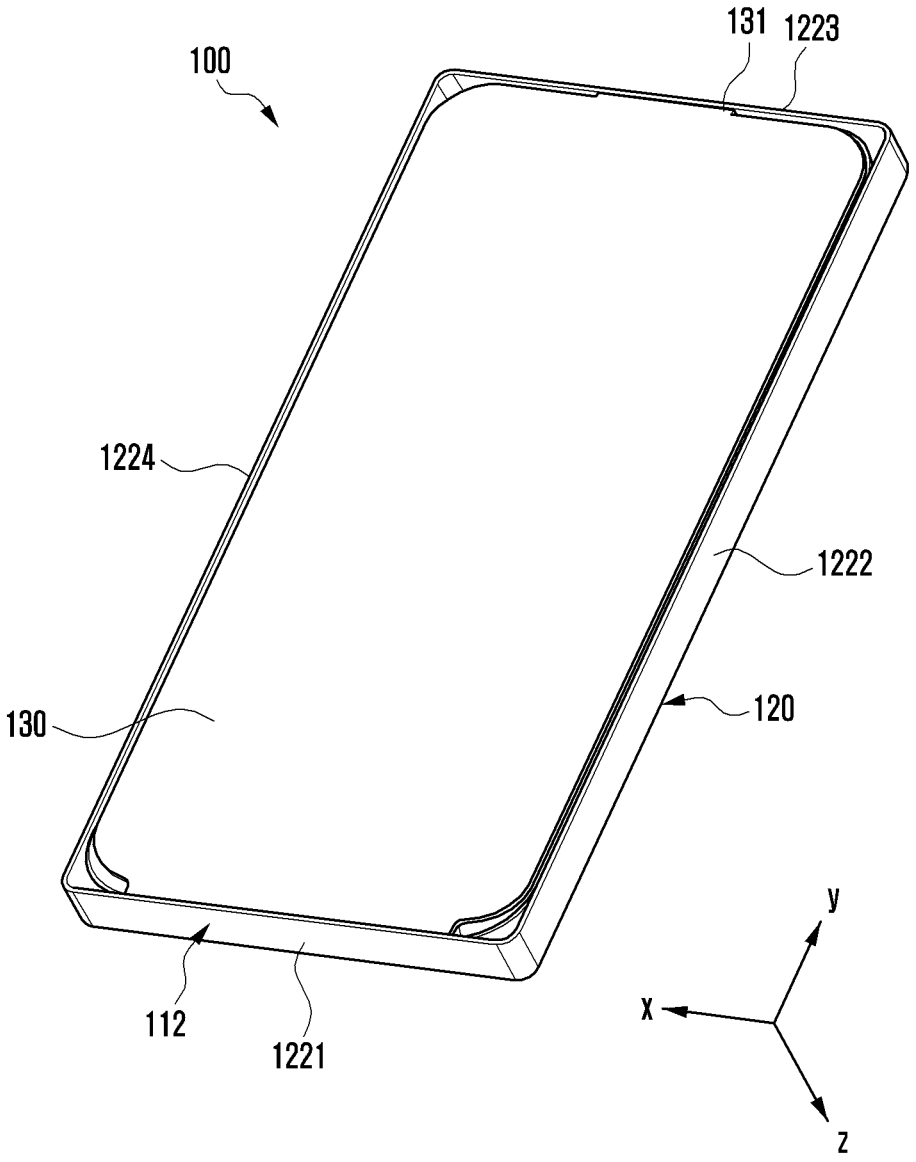
FIG. 1B is a rear perspective view of a package box assembly according to various embodiments.
Figure 1C:
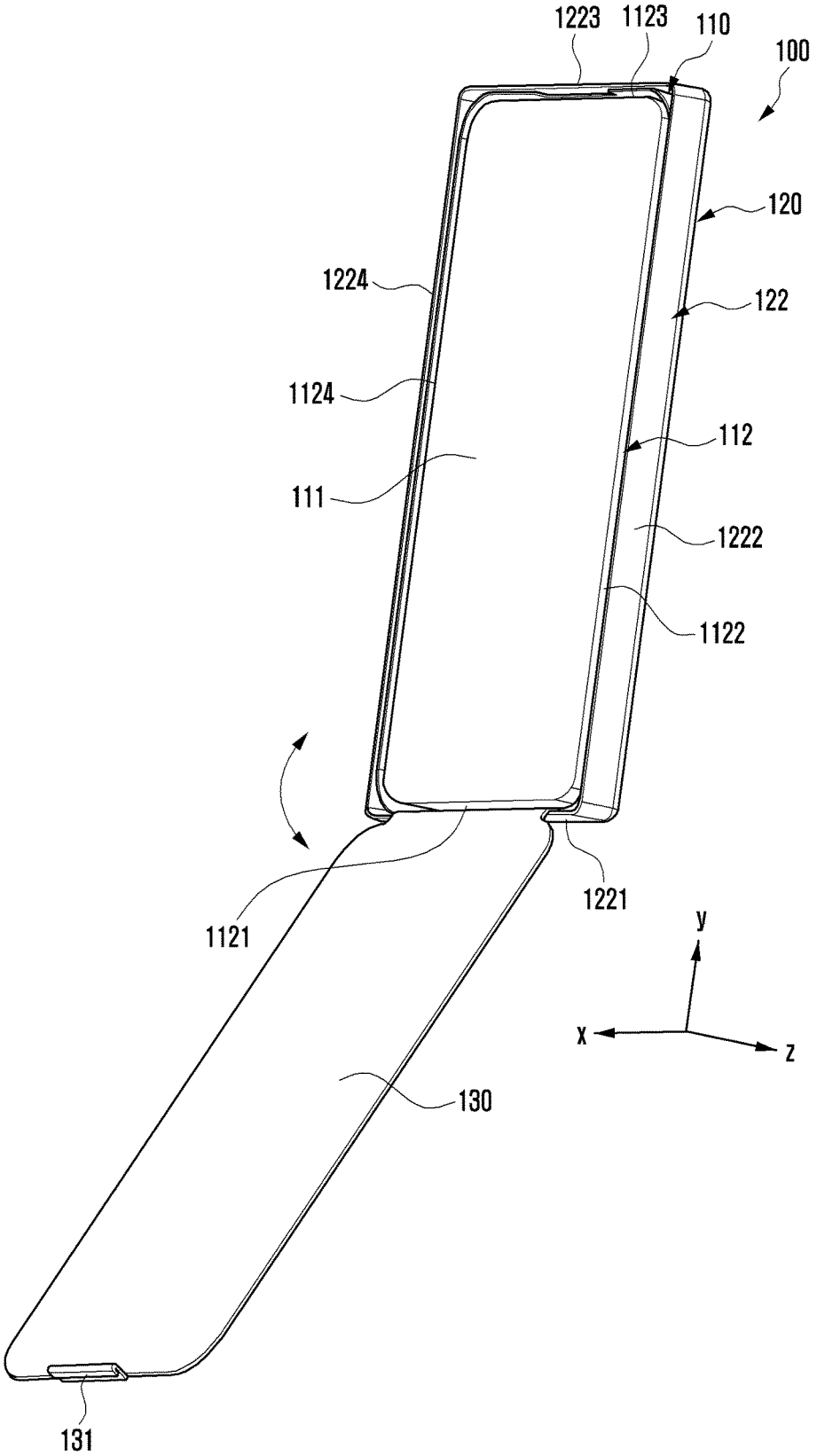
FIG. 1C is a rear perspective view of a package box assembly with a cover member opened according to various embodiments.
Figure 2:
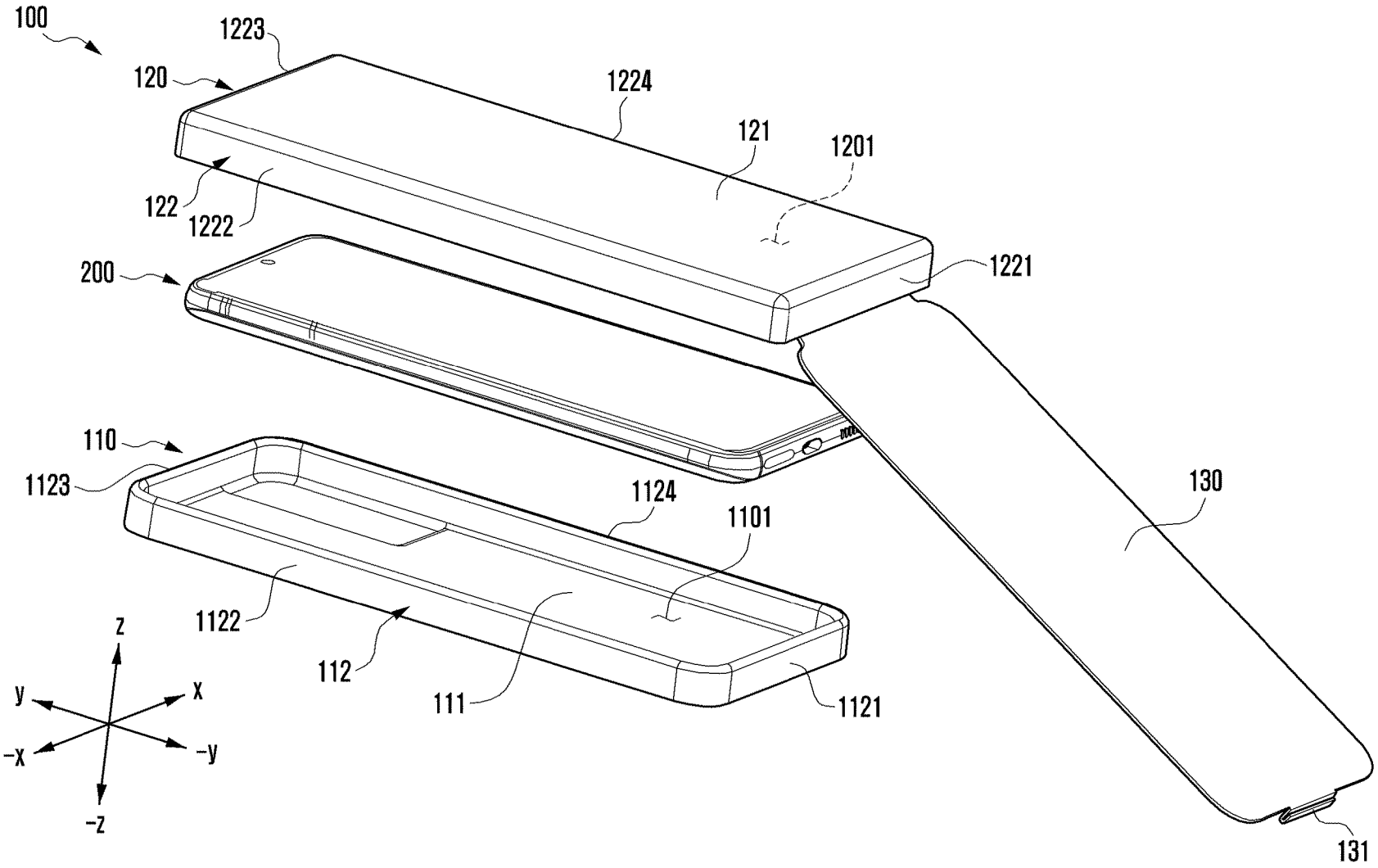
FIG. 2 is an exploded perspective view of a package box assembly according to various embodiments.

FIG. 1A is a front perspective view of a package box assembly according to various embodiments. FIG. 1B is a rear perspective view of a package box assembly according to various embodiments. FIG. 1C is a rear perspective view of a package box assembly with a cover member opened according to various embodiments. FIG. 2 is an exploded perspective view of a package box assembly according to various embodiments.

With reference to FIGS. 1A, 1B, 1C and 2 (which may be referred to as FIGS. 1A to 2), a package box assembly 100 may include a first box 110 and a second box 120 at least partially combined with the first box 110 to package a product such as an electronic device 200. According to an embodiment, the first box 110 may include a first plate portion 111 and a first sidewall 112 formed to have a designated height along edges of the first plate portion 111. According to an embodiment, the first sidewall 112 may have a first side surface 1121 having a first length, a second side surface 1122 extending from the first side surface 1121 in a perpendicular direction (e.g., in the y-axis direction) to have a second length greater than the first length, a third side surface 1123 extending from the second side surface 1122 in a perpendicular direction (e.g., in the x-axis direction) and having the first length, and a fourth side surface 1124 extending from the third side surface 1123 to the first side surface 1121 and having the second length. In various embodiments, the first box 110 may be formed in various shapes other than a rectangular shape, such as a circle, an oval, or a polygon. In various embodiments, the first box 110 may be formed such that the first length is greater than the second length. According to an embodiment, the first box 110 may include a first accommodation portion 1101 formed to accommodate at least a part of the electronic device 200 through the first plate portion 111 and the first sidewall 112. According to an embodiment, the first box 110 may be formed of an environmentally friendly pulp material. In various embodiments, the first box 110 may be formed by folding an unfolded laminated paper of at least two pieces of paper.

The second box 120 according to various embodiments may include a second plate portion 121 and a second sidewall 122 formed to have a designated height along edges of the second plate portion 121. According to an embodiment, the second sidewall 122 may have a fifth side surface 1221 having a third length, a sixth side surface 1222 extending from the fifth side surface 1221 in a perpendicular direction (e.g., in the y-axis direction) to have a fourth length greater than the third length, a seventh side surface 1223 extending from the sixth side surface 1222 in a perpendicular direction (e.g., in the x-axis direction) and having the third length, and an eighth side surface 1224 extending from the seventh side surface 1223 to the fifth side surface 1221 and having the fourth length. In various embodiments, the second box 120 may be formed in various shapes, such as a circle, an oval, a polygon, etc., rather than a rectangle, so as to correspond to the shape of the first box 110. In various embodiments, the second box 120 may be formed so that the first length is greater than the second length so as to correspond to the shape of the first box 110. According to an embodiment, the second box may also be formed of an environmentally friendly pulp material. In various embodiments, the second box may be formed in a manner in which at least two papers are laminated, punched in the form of a development paper, and then folded. According to an embodiment, the second box 120 may include a second accommodation portion 1201 for sealing the electronic device 200 accommodated in the first box 110 when at least a part of the first box 110 is covered with the second plate portion 121 and the second sidewall 122. According to an embodiment, when the first box 110 and the second box 120 are combined, the first sidewall 112 of the first box 110 and the second sidewall 122 of the second box 120 face each other, and the first sidewall 112 may be at least partially invisible from the outside.

According to various embodiments, the first sidewall 112 may include an inner wall (e.g., an inner wall 112*a* in FIG. 3B) and an outer wall (e.g., an outer wall 112*b* in FIG. 3B) bent from the inner wall 112*a* and spaced apart at a certain interval to form the first accommodation portion 1101 and secure rigidity for accommodating the electronic device 200. Therefore, when the first box 110 and the second box 120 are combined, the second sidewall 122 of the second box 120 may face the outer wall 112*b* of the first sidewall 112 of the first box 110. According to an embodiment, the outer wall 112*b* is formed with a wider gap from the inner wall 112*a* the farther away it is from a bent point, so that the outer wall 112*b* may fit tightly with the second sidewall 122 of the second box 120, thereby reducing the phenomenon of the second box 120 being separated from the first box 110.

According to various embodiments, when the first box 110 and the second box 120 are combined, the first plate portion 111 and a part of the first sidewall 112 of the first box 110 are exposed to the outside on the rear surface of the package box assembly 100, which may hinder the formation of an attractive appearance of the package box assembly 100. According to an embodiment, the second box 120 may include a cover member 130 arranged in an at least partially foldable manner. According to an embodiment, one end of the cover member 130 may be foldably fixed to a certain side (e.g., the fifth side surface 1221) of the second sidewall 122, and the other end may be fixed in a folded state to a certain side (e.g., the seventh side surface 1223) of the second sidewall 122 in a manner of being hooked by a hooking structure (e.g., a hooking portion 131). Accordingly, when the cover member 130 is folded after the first box 110 and the second box 120 are combined, the plate portion 111 and the first sidewall 112 of the first box 110 arranged on the rear surface of the package box assembly 100 are covered by the cover member 130, thereby helping to form an attractive appearance. According to an embodiment, the cover member 130 may also be formed of an environmentally friendly pulp material or may be formed of a laminated paper of at least one piece of paper. In various embodiments, the cover member 130 may be formed integrally with the second box 120. In various embodiments, the cover member 130 may be arranged in a manner in which it is attached to the second box 120.

Figure 3A:
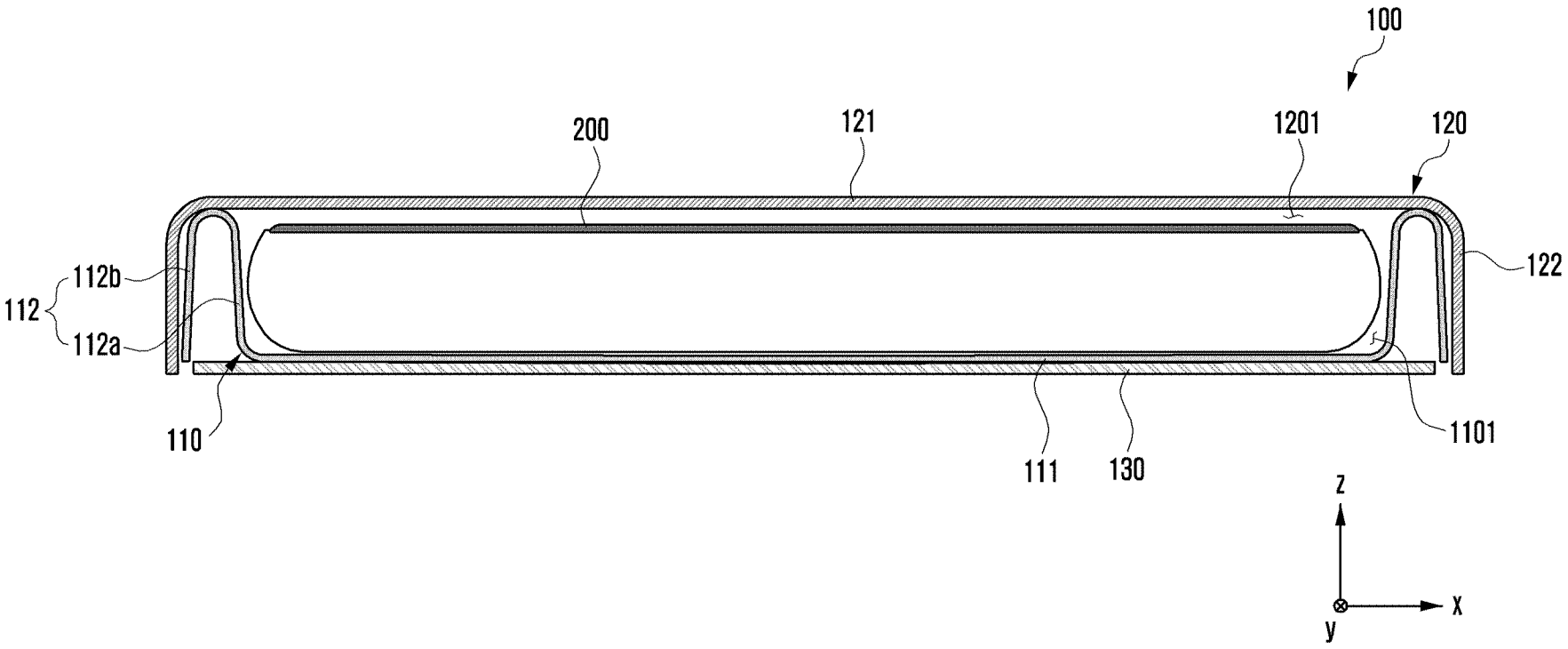
FIG. 3A is a cross-sectional view of a package box assembly taken along line 3*a*-3*a* of FIG. 1A according to various embodiments.
Figure 3B:
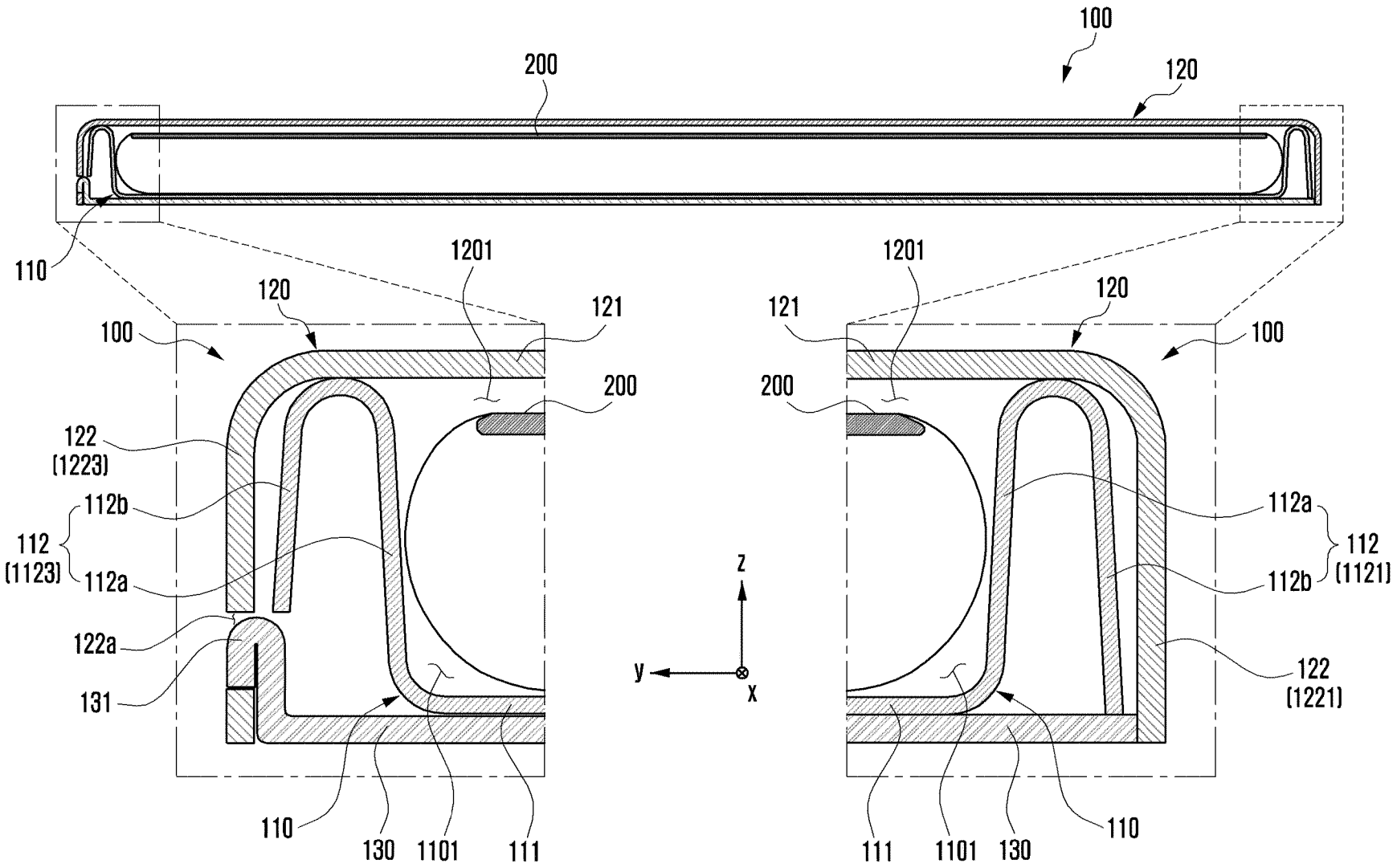
FIG. 3B is a cross-sectional view of a package box assembly taken along line 3*b*-3*b* of FIG. 1A according to various embodiments.

FIG. 3A is a cross-sectional view of a package box assembly taken along line 3*a*-3*a* of FIG. 1A according to various embodiments. FIG. 3B is a cross-sectional view of a package box assembly taken along line 3*b*-3*b* of FIG. 1A according to various embodiments.

With reference to FIGS. 3A and 3B, the package box assembly 100 may include the first box 110 having the first accommodation portion 1101 for accommodating the electronic device 200, and the second box 120 having the second accommodation portion 1201 formed to seal the electronic device 200 by combination with the first box 110 and to surround at least a part of the first box 110. According to an embodiment, the second box 120 may include the cover member 130 arranged in an at least partially foldable manner. According to an embodiment, the package box assembly 100 may include the cover member 130 that is foldably fixed, at one end, to a certain side (e.g., the fifth side surface 1221) of the second sidewall 122 and is fixed in a folded state, at the other end, to a certain side (e.g., the fifth side surface 1221) of the second sidewall 122 in a manner of being hooked by a hooking structure. According to an embodiment, when the cover member 130 is folded after the first box 110 and the second box 120 are combined, the plate portion 111 and the first sidewall 112 of the first box 110 arranged on the rear surface of the package box assembly 100 may be covered by the cover member 130.

According to various embodiments, the package box assembly 100 may include the hooking structure for fixing the position when the cover member 130 is positioned on the rear surface in a foldable manner. According to an embodiment, the hooking structure may include a hooking portion 131 (e.g., a hooking projection or a hook) arranged at an end of the cover member 130, and a hooking groove 122*a* (e.g., a recess or a hooking hole) formed on a certain side of the second box 120. According to an embodiment, the hooking portion 131 may be formed to have a thickness greater than the thickness of the cover member 130 in a manner in which a part of the end of the cover member 130 is partially folded. In various embodiments, the hooking portion 131 may be separately attached to the end of the cover member 130. Accordingly, at least a part of the hooking portion 131 is hooked in the hooking groove 122*a* after the cover member 130 is folded to the rear surface of the package box assembly 100, so that the cover member 122 does not open arbitrarily and can help improve the combining strength between the first box 110 and the second box 120.

Figure 4:
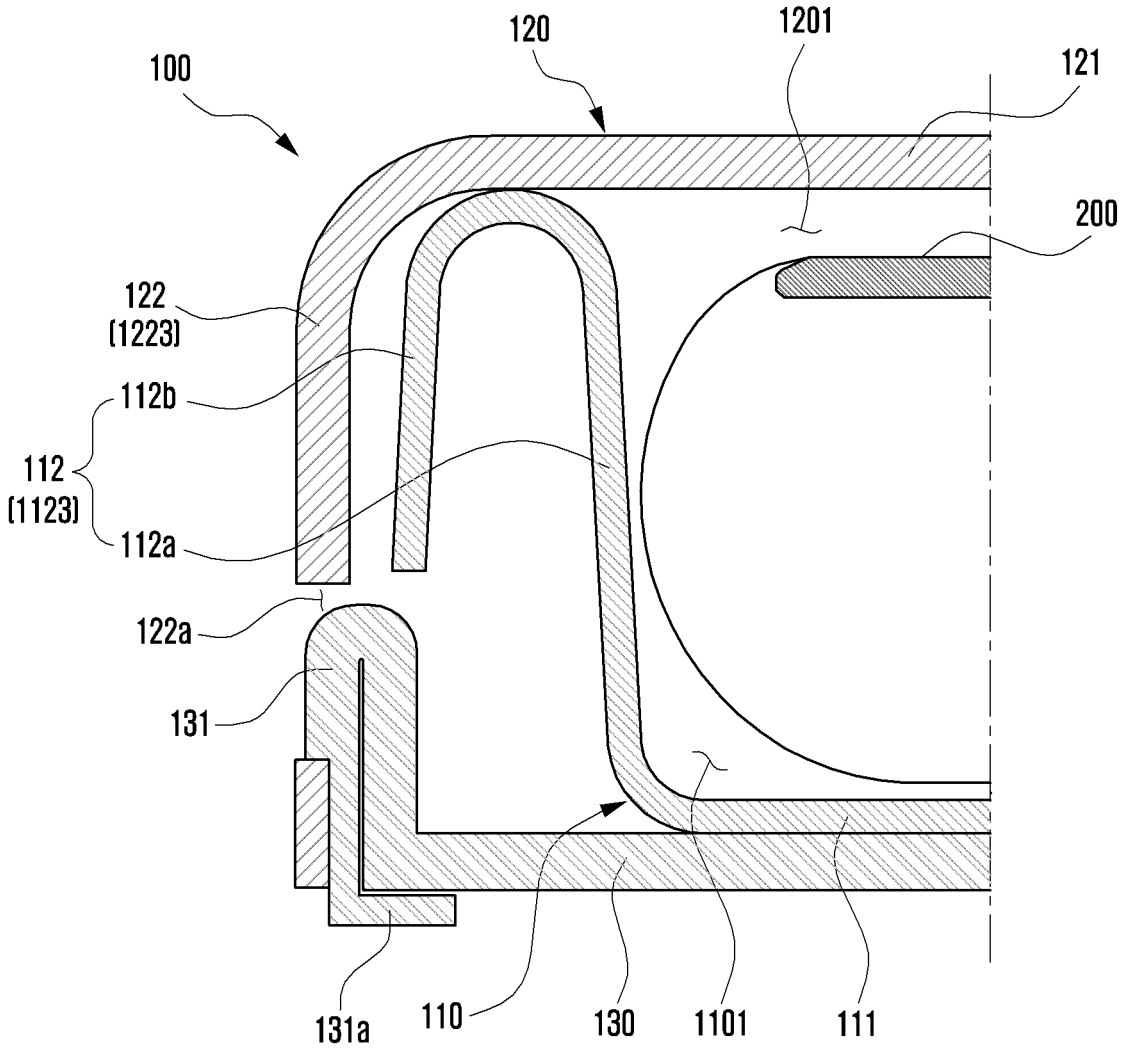
FIG. 4 is a partial cross-sectional view of a portion of a package box assembly including a hooking structure according to various embodiments.
Figure 5A:
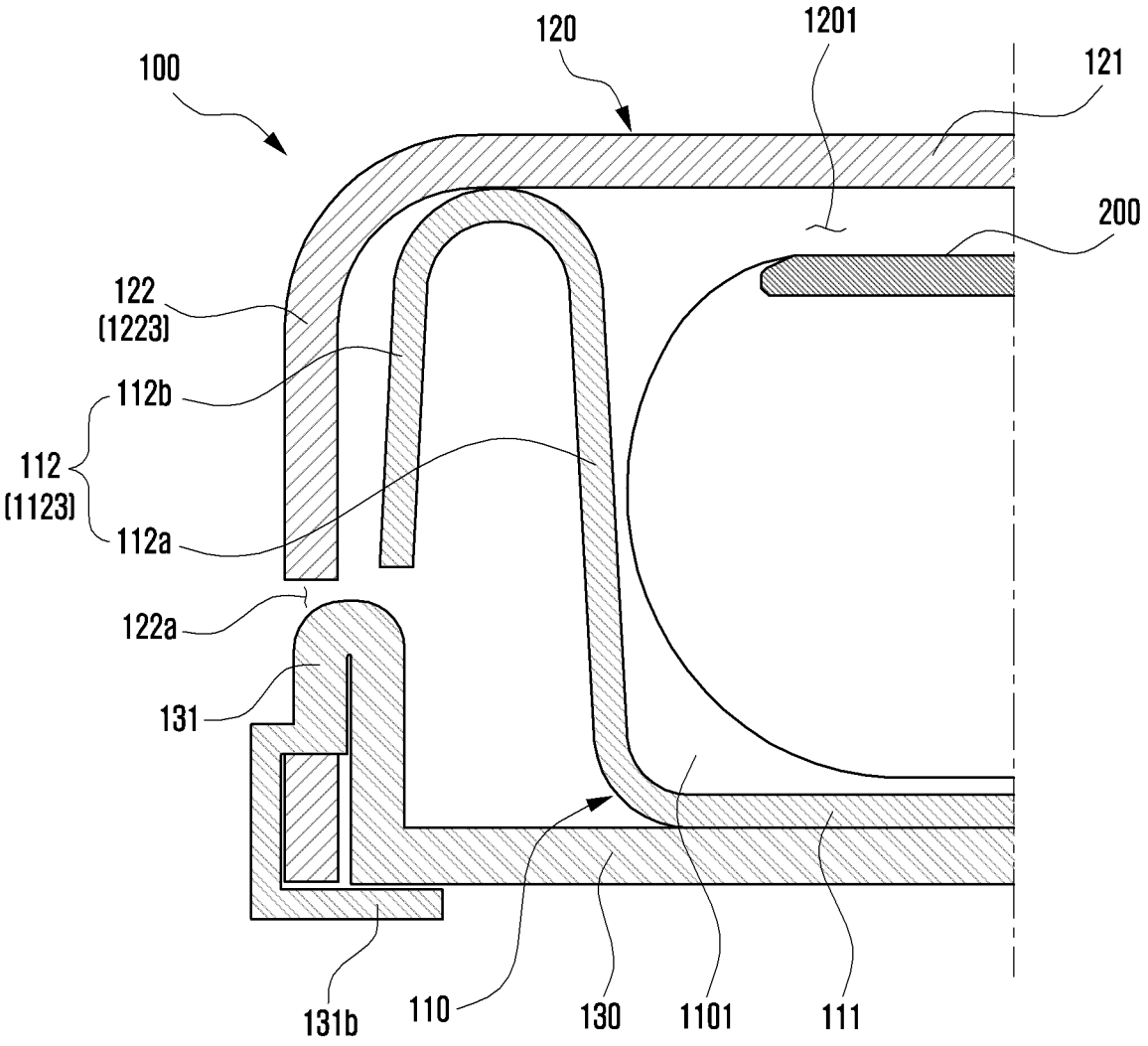
FIG. 5A is a partial cross-sectional view of a portion of a package box assembly including a hooking structure according to various embodiments.
Figure 5B:
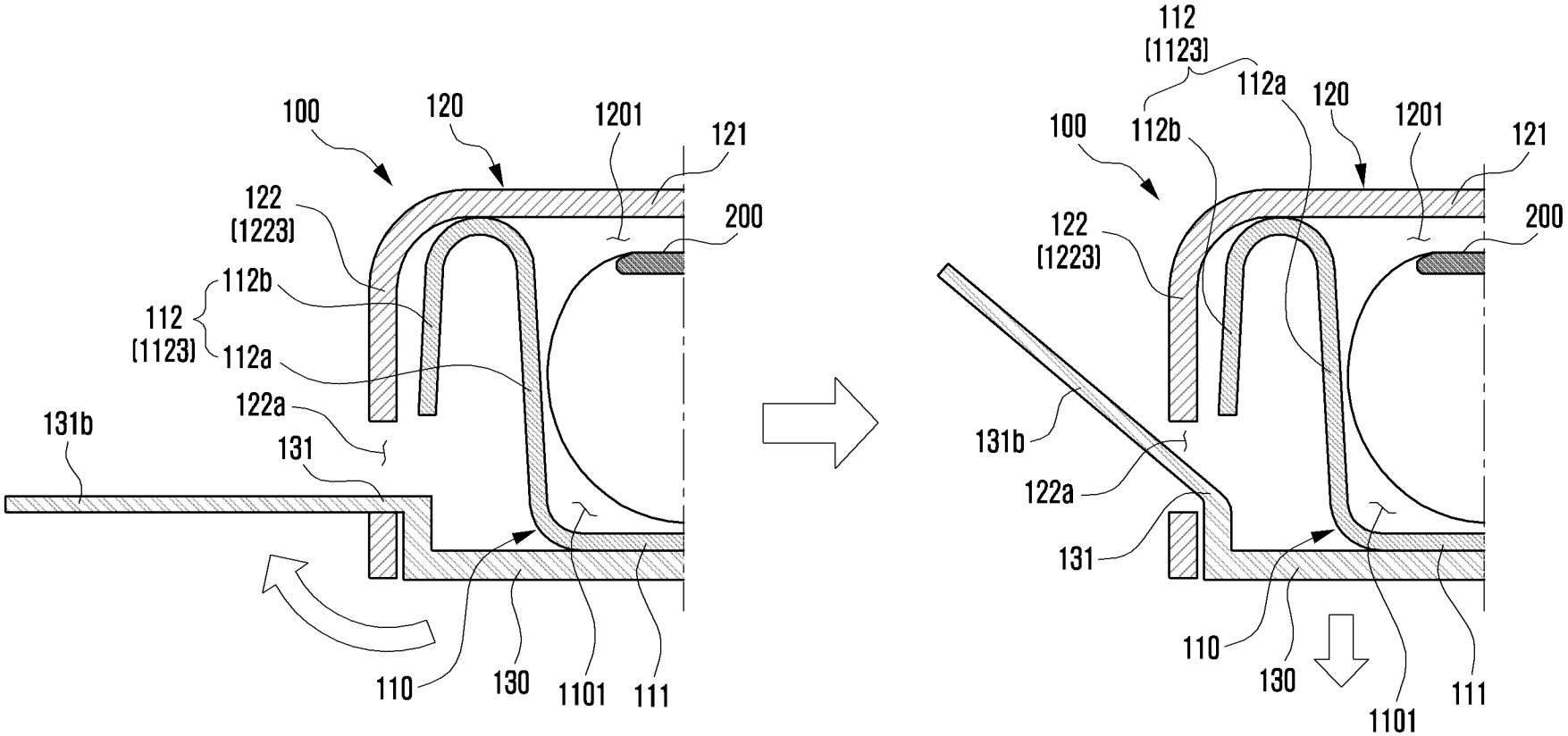
FIGS. 5B and 5C are partial cross-sectional views illustrating operational views in which the hooking structure of FIG. 5A is released according to various embodiments.
Figure 5C:
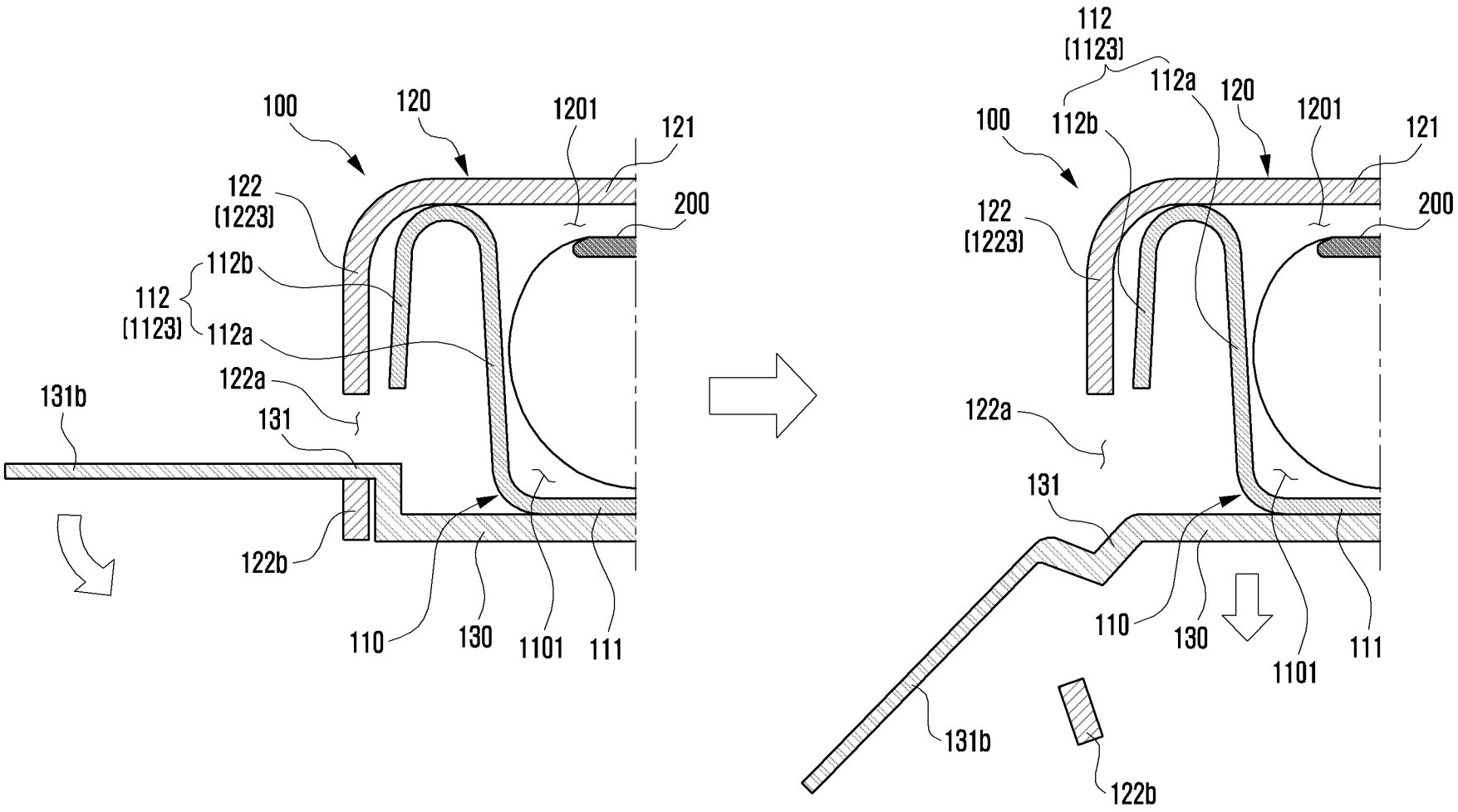

FIG. 4 is a partial cross-sectional view of a portion of a package box assembly including a hooking structure according to various embodiments. FIG. 5A is a partial cross-sectional view of a portion of a package box assembly including a hooking structure according to various embodiments. FIGS. 5B and 5C are partial cross-sectional views illustrating operational states in which the hooking structure of FIG. 5A is released according to various embodiments.

In describing the package box assembly 100 of FIGS. 4, 5A, 5B and 5C (which may be referred to as FIGS. 4 to 5C), the same reference numerals are given to components that are substantially the same as those of the package box assembly 100 of FIG. 3B, and a detailed description thereof may not be repeated here.

With reference to FIG. 4, the cover member 130 may further include an extension 131*a* extended from the hooking portion 131. In this case, the extension 131*a* may be arranged in a manner that folds toward the rear surface of the cover member 130. Accordingly, the user can easily separate the cover member 130 using, as a handle, the extension 131*a* attached to the rear surface of the cover member 130 located on the rear surface of the package box assembly 100 and exposed to the outside.

With reference to FIGS. 5A and 5B, the cover member 130 may include an extension 131*b* that extends from the hooking portion 131, passes through the hooking groove 122*a*, is folded again, and is then attached to the rear surface of the cover member 130. In this case, the user can easily detach the cover member by unfolding the extension 131*b* attached to the rear surface of the cover member 130 from the rear surface of the package box assembly 100 and then pushing it back toward the hooking groove 122*a*.

With reference to FIG. 5C, the second box 120 may include a certain portion 122*b* having a detachable cut line formed at the lower side based on the hooking groove 122*a*. Accordingly, when the user unfolds the extension 131*b* attached to the rear surface of the cover member 130 from the rear surface of the package box assembly 100 and applies a certain force downward, the portion 122*b* formed integrally with the second box 120 is separated by being torn along the cut line, thereby easily detaching the cover member 130.

Figure 6A:
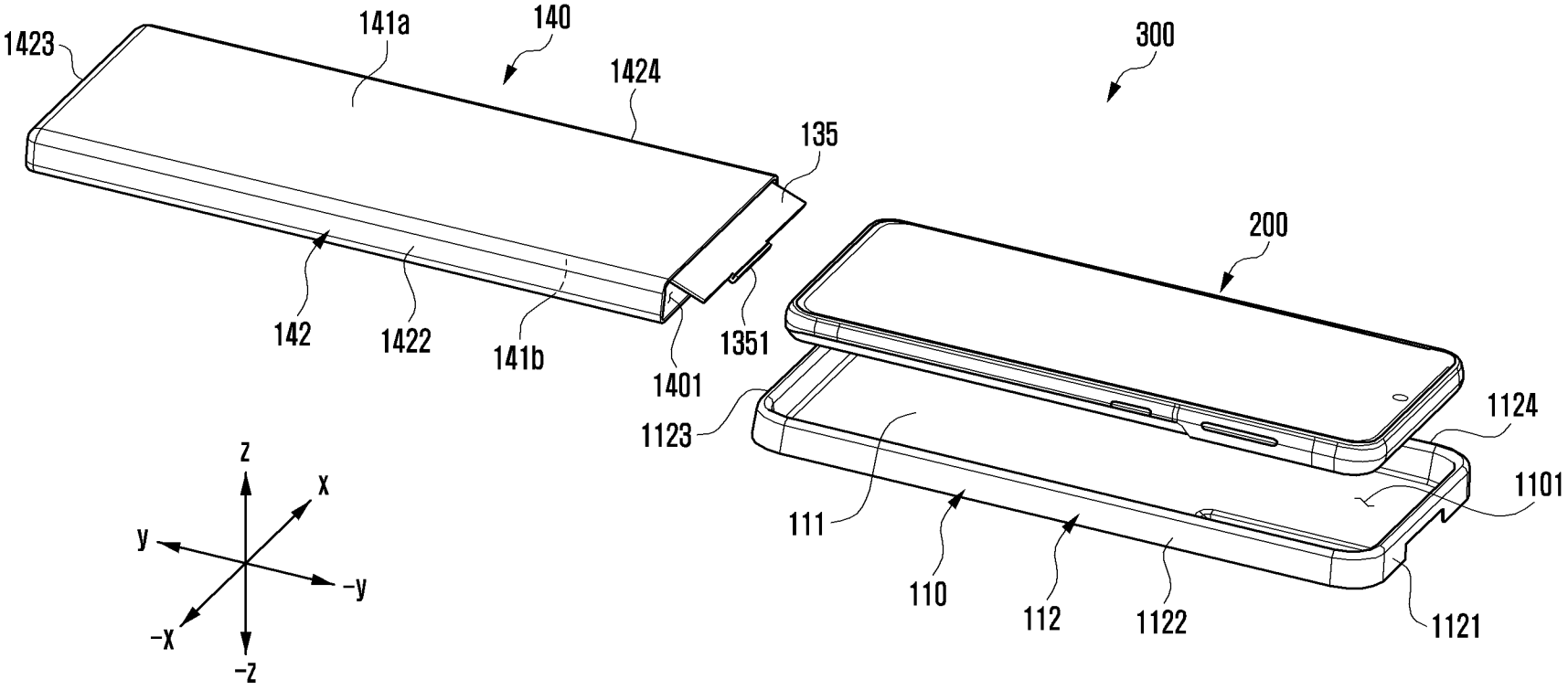
FIG. 6A is an exploded perspective view of a package box assembly according to various embodiments.
Figure 6B:
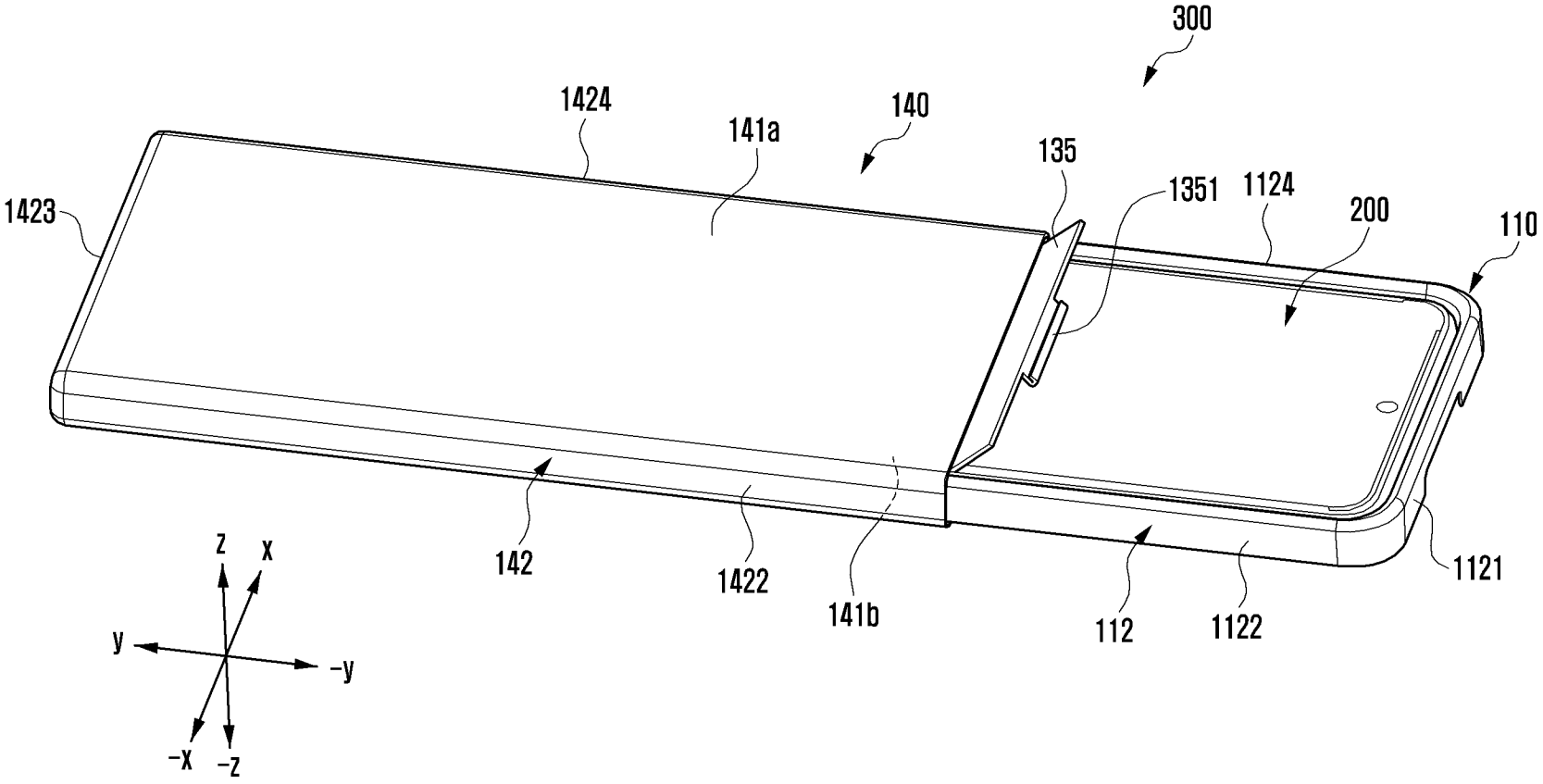
FIGS. 6B and 6C are perspective views illustrating an assembly process of a package box assembly according to various embodiments.
Figure 6C:
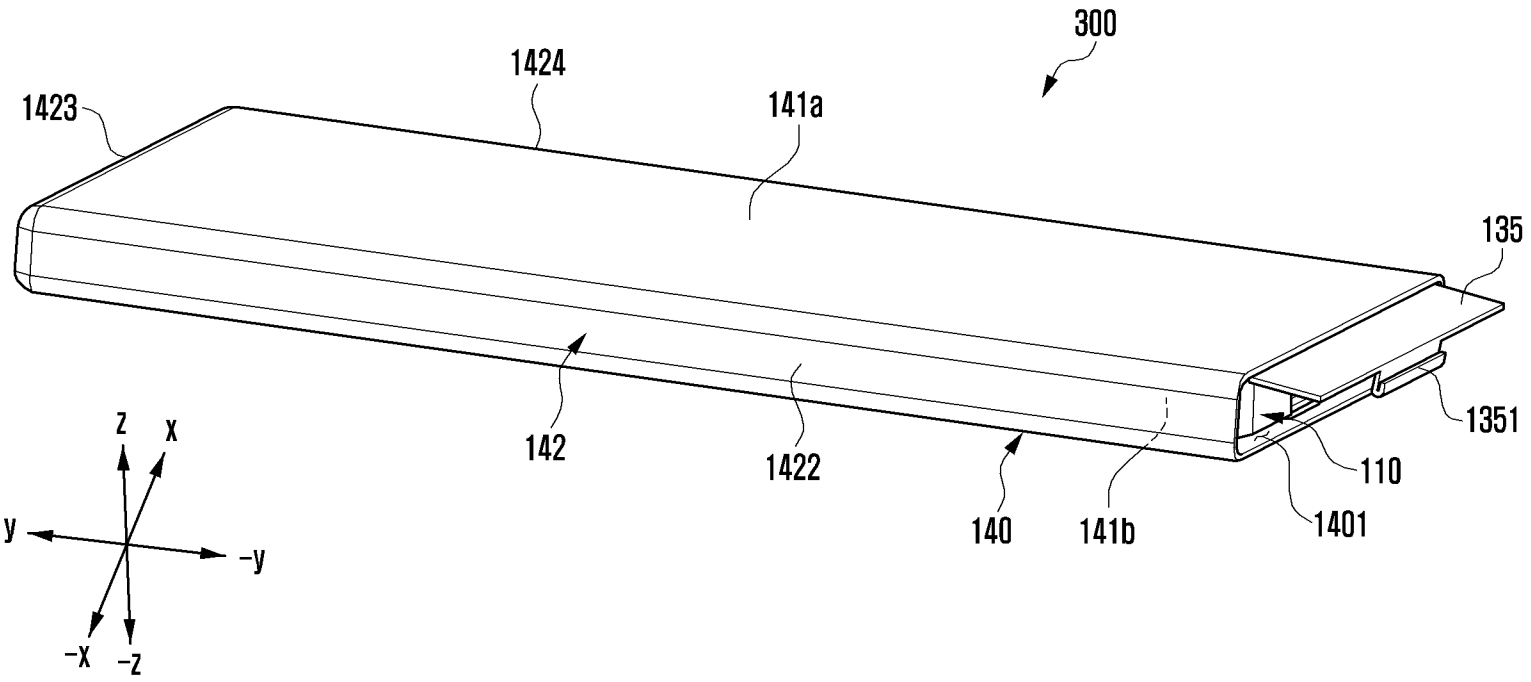
Figure 7A:
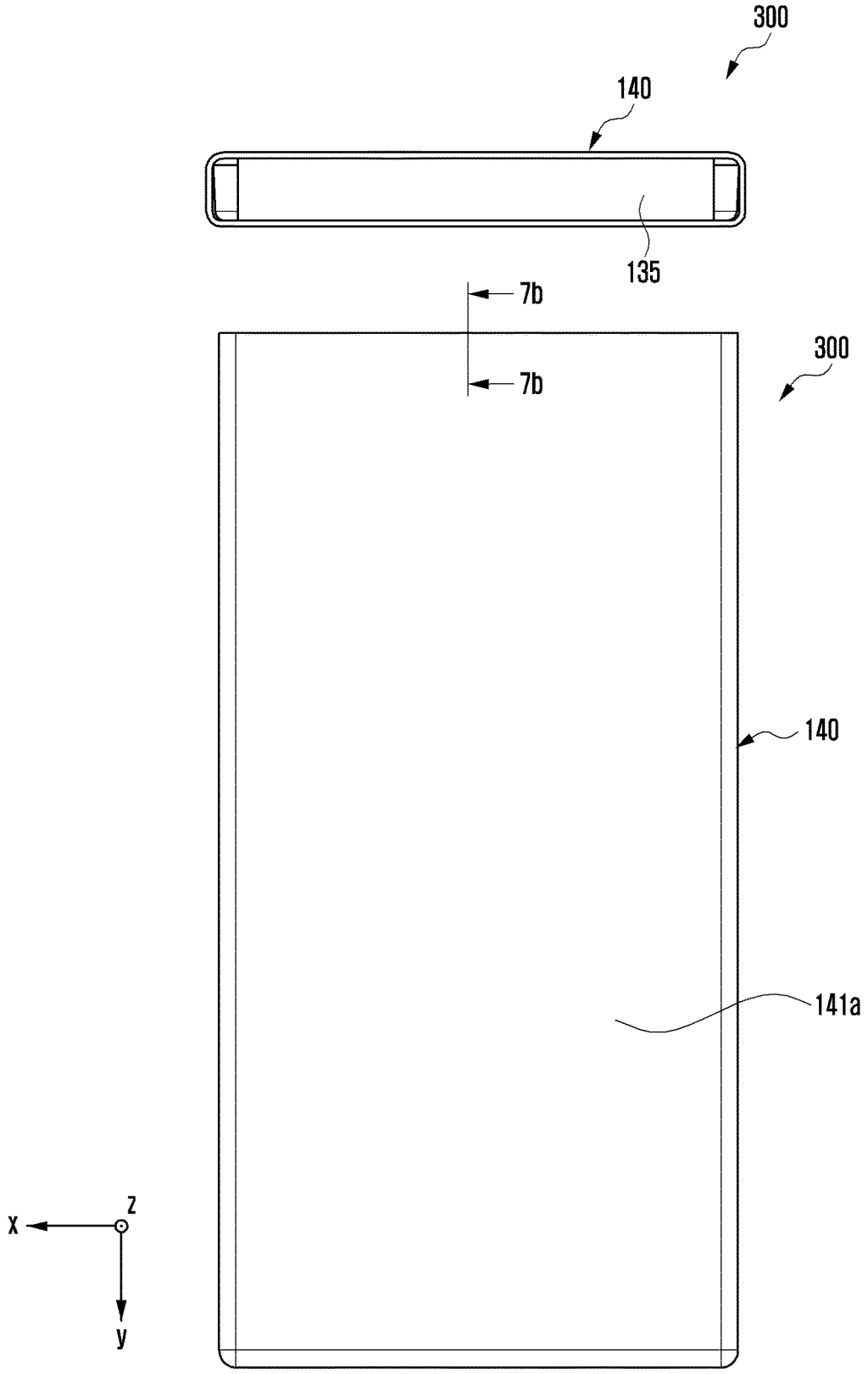
FIG. 7A is a diagram illustrating a plan view of a package box assembly according to various embodiments.
Figure 7B:
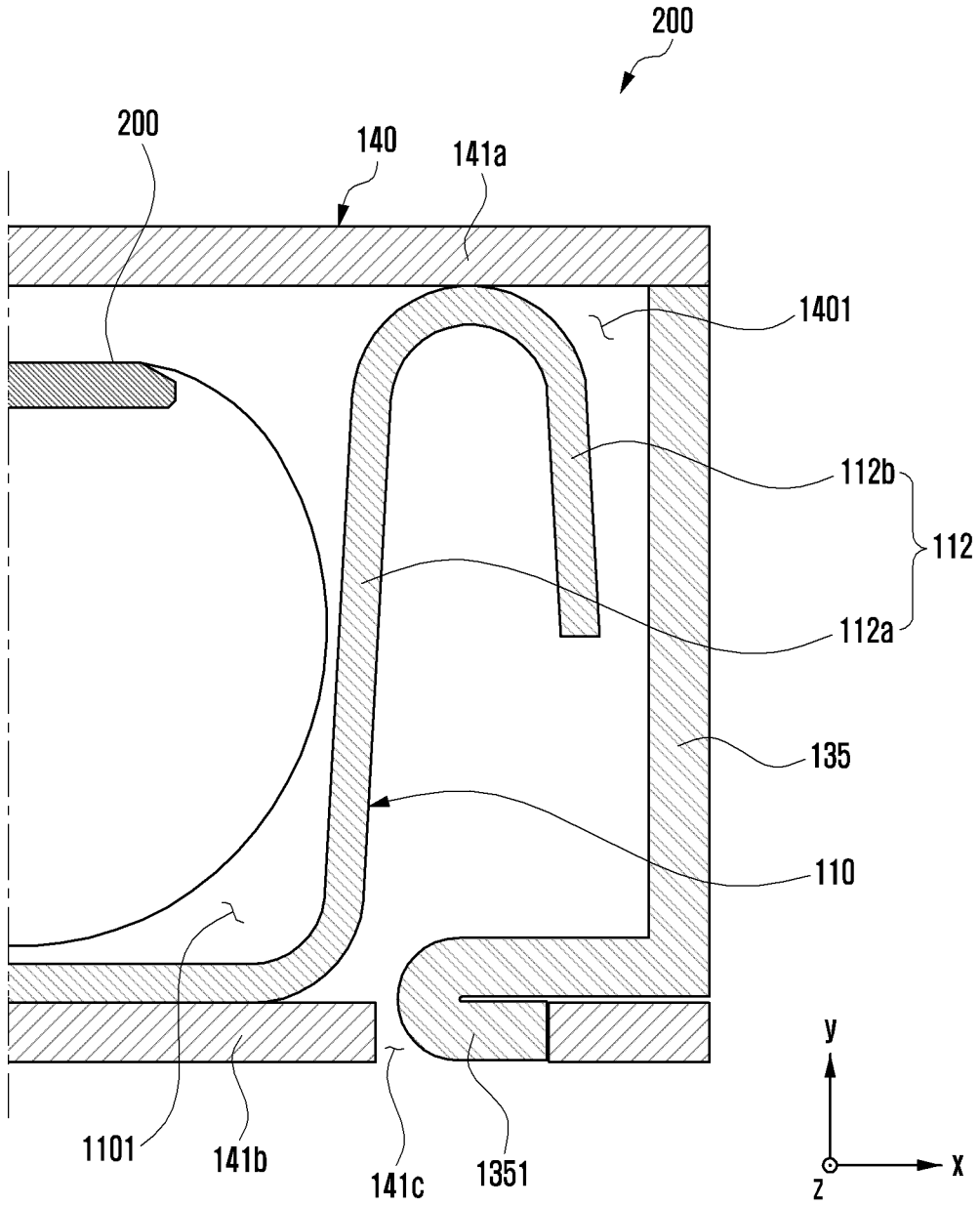
FIG. 7B is a cross-sectional view of a package box assembly taken along line 7*b*-7*b* of FIG. 7A according to various embodiments.

FIG. 6A is an exploded perspective view of a package box assembly according to various embodiments. FIGS. 6B and 6C are perspective views illustrating an assembly process of a package box assembly according to various embodiments. FIG. 7A is a diagram illustrating a plan view of a package box assembly according to various embodiments. FIG. 7B is a partial cross-sectional view of a package box assembly taken along line 7*b*-7*b* of FIG. 7A according to various embodiments.

In describing the package box assembly 300 of FIGS. 6A, 6B, 6C, 7A and 7B (which may be referred to as FIGS. 6A to 7B), the same reference numerals are given to components that are substantially the same as those of the package box assembly 100 of FIGS. 1A to 3B, and a detailed description thereof may not be repeated here.

With reference to FIGS. 6A to 7B, the package box assembly 300 may include a first box 110 that includes a first plate portion 111 and a first accommodation portion 1101 for accommodating the electronic device by a first sidewall 112 formed along edges of the first plate portion 111, and a second box 140 that includes a second accommodation portion 1401 for accommodating the entire first box 110. According to an embodiment, the second box 140 may have a second plate portion 141*a*, a third plate portion 141*b* spaced apart from the second plate portion 141*a*, and a second sidewall 142 forming the second accommodation portion 1401 by surrounding at least a part of a space between the second plate portion 141*a* and the third plate portion 141*b*. According to an embodiment, the second sidewall 142 may have a fifth side surface 1422 facing the second side surface 1122 of the first box 11, a sixth side surface 1423 facing the third side surface 1123, and a seventh side surface 1424 facing the fourth side surface 1124 when the package box assembly 300 is assembled. For example, an area of the second box 140 facing the first side surface 1121 may be open and connected to a second accommodation portion 1401 for accommodating the first box 110.

According to various embodiments, the second box 140 may include a cover member 135 for sealing the open area when the first box 110 is accommodated in the second accommodation portion 1401. According to an embodiment, the cover member 135 may be bendably fixed by being integrally formed with or attached to a part of the second plate portion 141*a*, thereby sealing the open area after the first box 110 is accommodated in the second accommodation portion 1401. In various embodiments, the cover member 135 may have one end bendably fixed to the third plate portion 141*b*. In various embodiments, the cover member 135 may have one end bendably fixed to the fifth side 1422 or the seventh side 1424.

According to various embodiments, the cover member 135 may have a hooking structure for sealing the open area of the second box 140 and then maintaining the state. According to an embodiment, the hooking structure may include a hooking portion 1351 formed at the other end of the cover member 135 and a hooking groove 141*c* formed at the third plate 141*b* of the second box 140. Accordingly, when the first box 110 containing the electronic device 200 is accommodated in the second accommodation portion 1401 and the open space is sealed by bending the cover member 135, the hooking portion 1351 formed at the end of the cover member 135 is hooked into the hooking groove 141*c* of the second box 140, thereby preventing and/or reducing the phenomenon of arbitrary detachment. Although not shown, the hooking portion 1351 of the cover member 135 may further include the extension 131*a* of FIG. 4 or the extension 131*b* of FIGS. 5A, 5B and 5C, thereby allowing the user to easily separate the cover member 135.

Figure 8A:
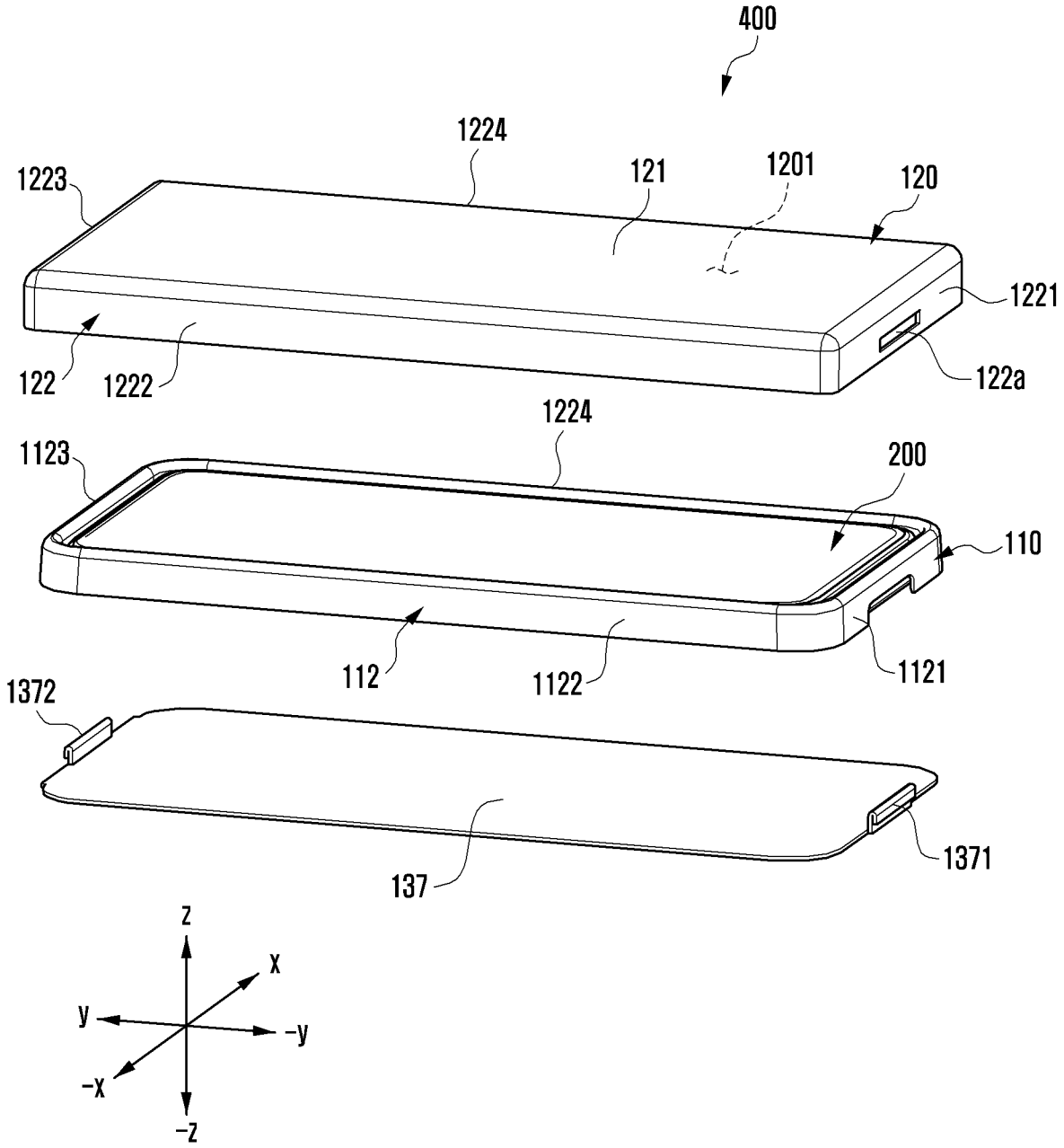
FIG. 8A is an exploded perspective view of a package box assembly according to various embodiments.
Figure 8B:
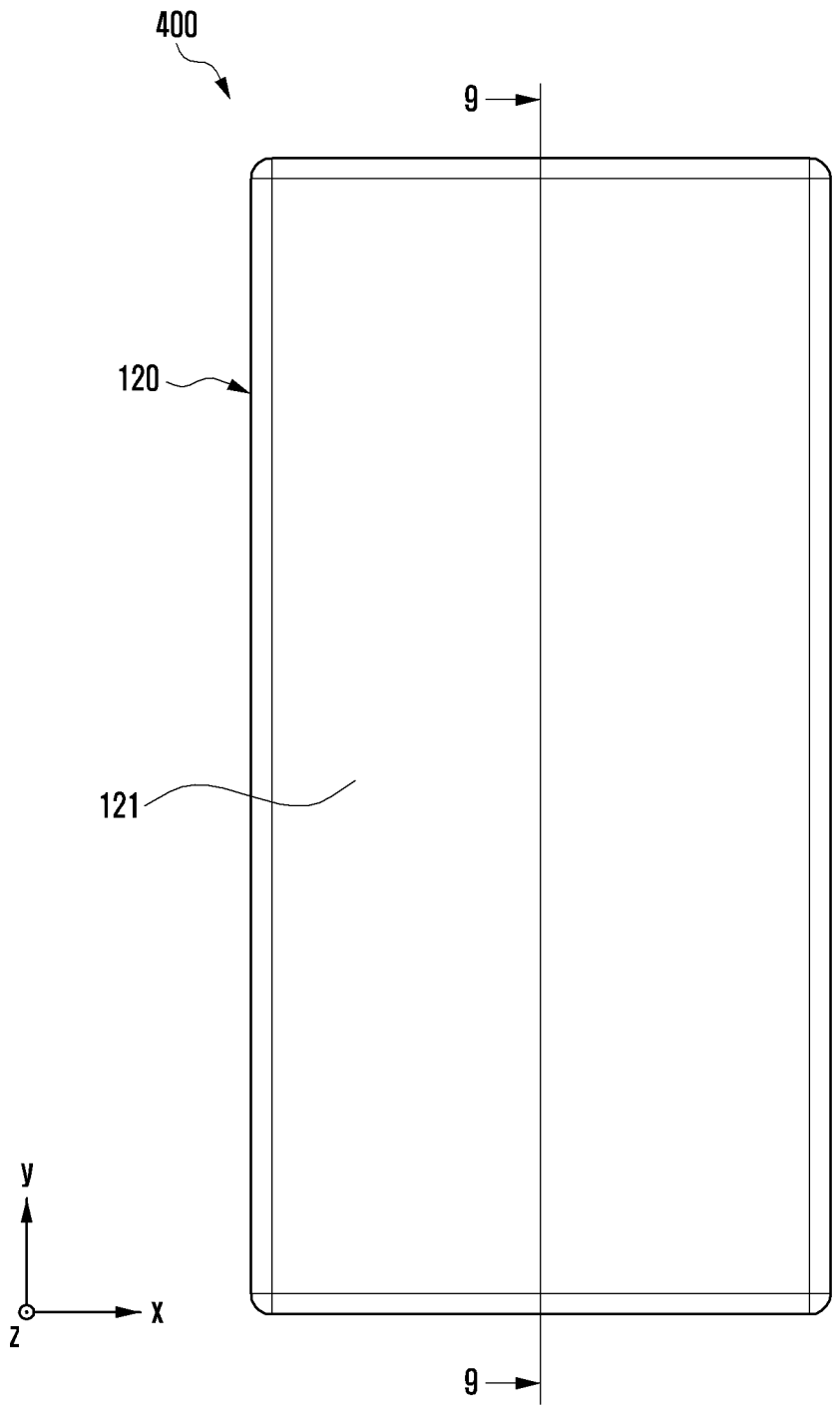
FIG. 8B is a diagram illustrating a plan view of a package box assembly according to various embodiments.
Figure 8C:
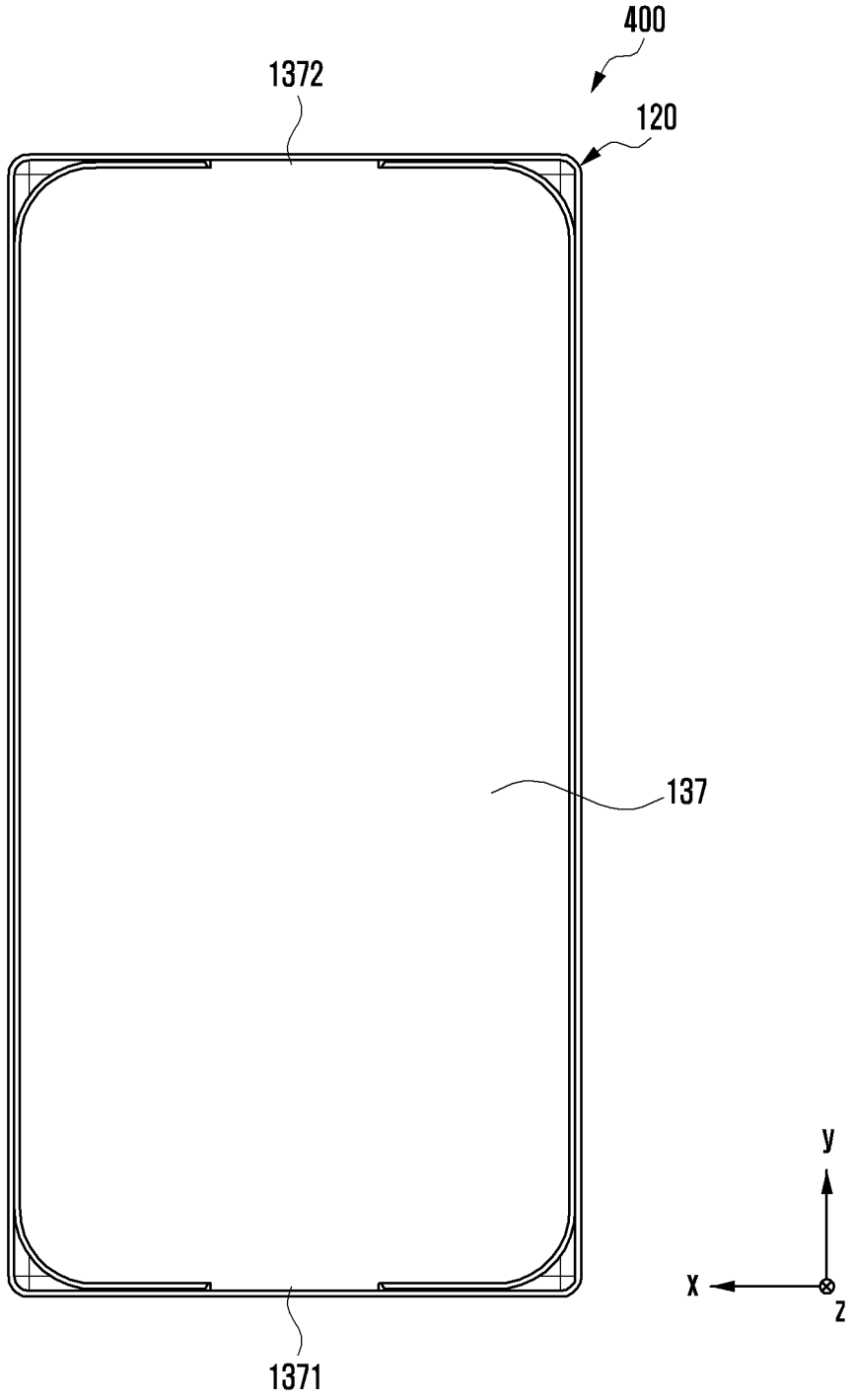
FIG. 8C is a diagram illustrating a rear view of a package box assembly according to various embodiments.
Figure 9:
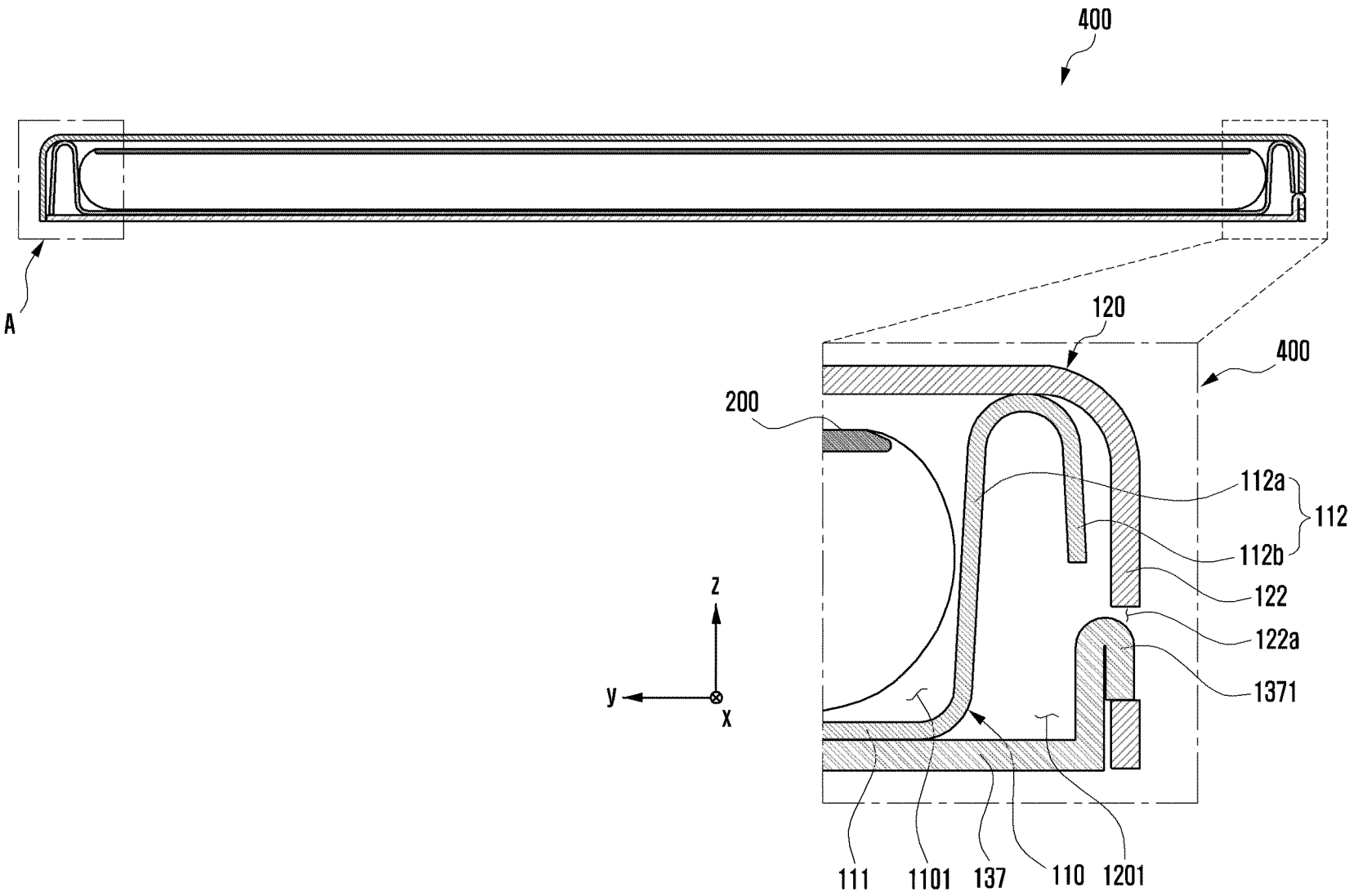
FIG. 9 is a cross-sectional view of a package box assembly taken along line g-g of FIG. 8B according to various embodiments.

FIG. 8A is an exploded perspective view of a package box assembly according to various embodiments. FIG. 8B is a diagram illustrating a plan view of a package box assembly according to various embodiments. FIG. 8C is a diagram illustrating a rear view of a package box assembly according to various embodiments. FIG. 9 is a cross-sectional view of a package box assembly taken along line g-g of FIG. 8B according to various embodiments.

In describing the package box assembly 400 of FIGS. 8A, 8B, 8C and 9 (which may be referred to as FIGS. 8*a* to 9), the same reference numerals are given to components that are substantially the same as those of the package box assembly 100 of FIGS. 1A to 3B, and a detailed description thereof may not be repeated here.

With reference to FIGS. 8A to 9, the package box assembly 400 may include a first box 110 including a first accommodation portion 1101 for accommodating an electronic device 200, and a second box 120 including a second accommodation portion 1201 formed to seal the electronic device 200 by being combined with the first box 110 and enclose at least a part of the first box 110.

According to various embodiments, the package box assembly 400 may include a cover member 137 coupled to the rear surface of the package box assembly 400 through a hooking structure, when the first box 110 and the second box 120 are assembled. According to an embodiment, the hooking structure may include a first hooking portion 1371 arranged at one end of the cover member 137 and a second hooking portion 1372 arranged at the other end. According to an embodiment, the hooking structure may include a first hooking groove 122*a* formed in a specific side (e.g., the fifth side surface 1221) of a second sidewall 122 of the second box 120 and a second hooking portion (not shown) formed on a side (e.g., the seventh side surface 1223) opposite to the specific side. According to an embodiment, the second hooking portion may be formed in substantially the same manner as the first hooking portion 122*a*. According to an embodiment, the cover member 137 may be fixed in such a manner that the first hooking portion 1371 is hooked into the first hooking groove 122*a*, as shown in FIG. 9. Similarly, the second hooking portion 1372 is also hooked into the second hooking groove in substantially the same manner as the first hooking portion 1371 is hooked into the first hooking groove 122*a*, in area A of FIG. 9, so that the plate portion 111 and the first sidewall 112 of the first box 110 arranged on the rear surface of the package box assembly 100 may be covered by the cover member 137. Although not shown, the hooking portions 1371 and 1372 of the cover member 137 may further include the extension 131*a* of FIG. 4 or the extension 131*b* of FIGS. 5A to 5C, thereby allowing the user to easily separate the cover member 137.

Figure 10A:
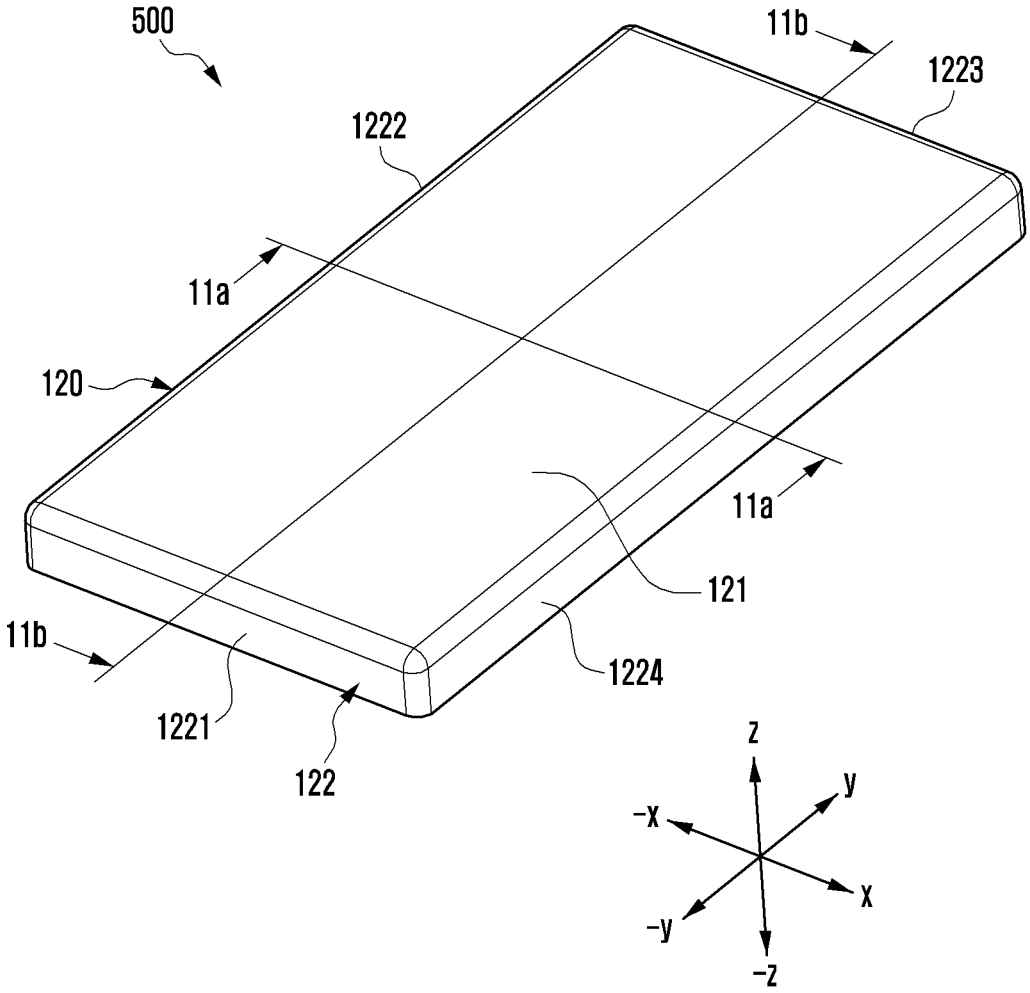
FIG. 10A is a perspective view of a package box assembly according to various embodiments.
Figure 10B:
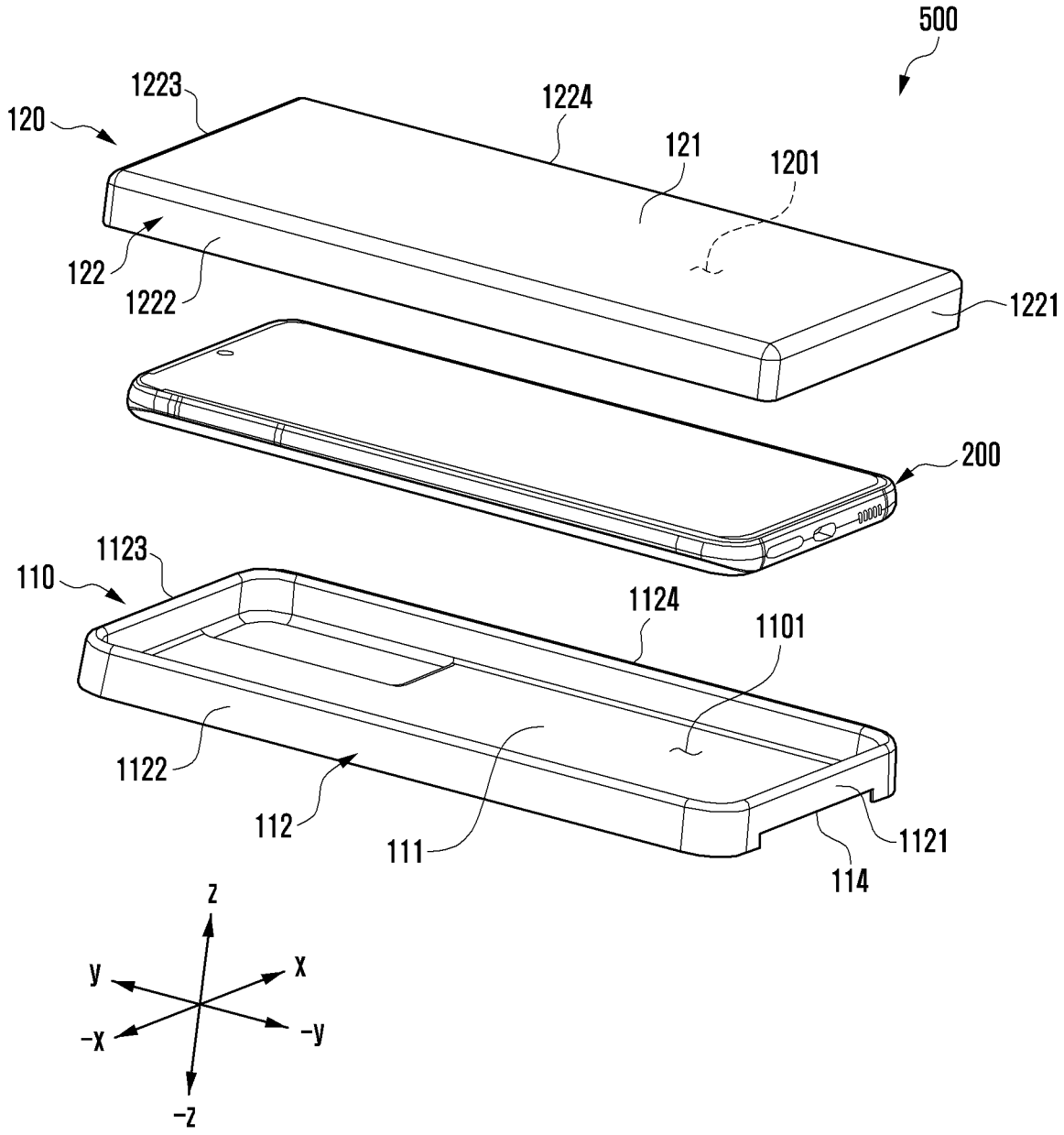
FIG. 10B is an exploded perspective view of a package box assembly according to various embodiments.
Figure 11A:
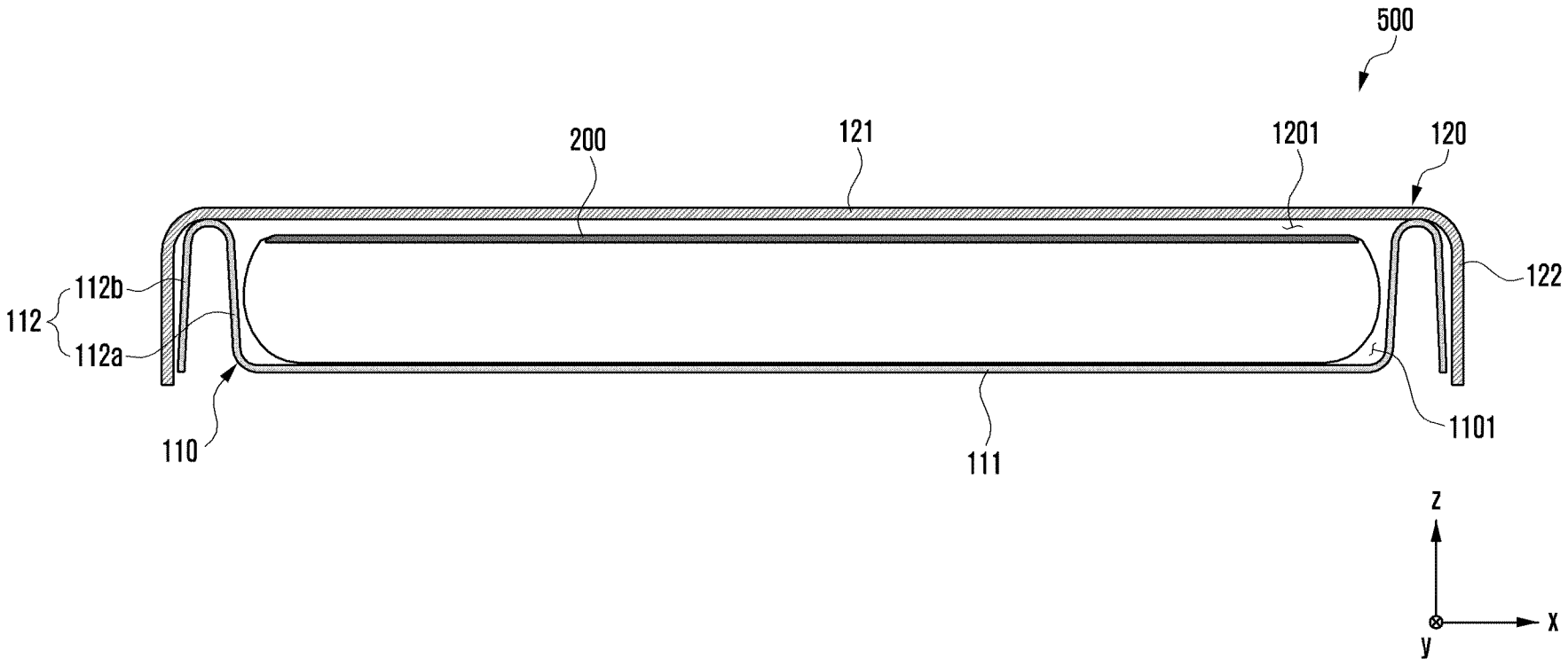
FIG. 11A is a cross-sectional view of a package box assembly taken along line 11*a*-11*a* of FIG. 10A according to various embodiments.
Figure 11B:
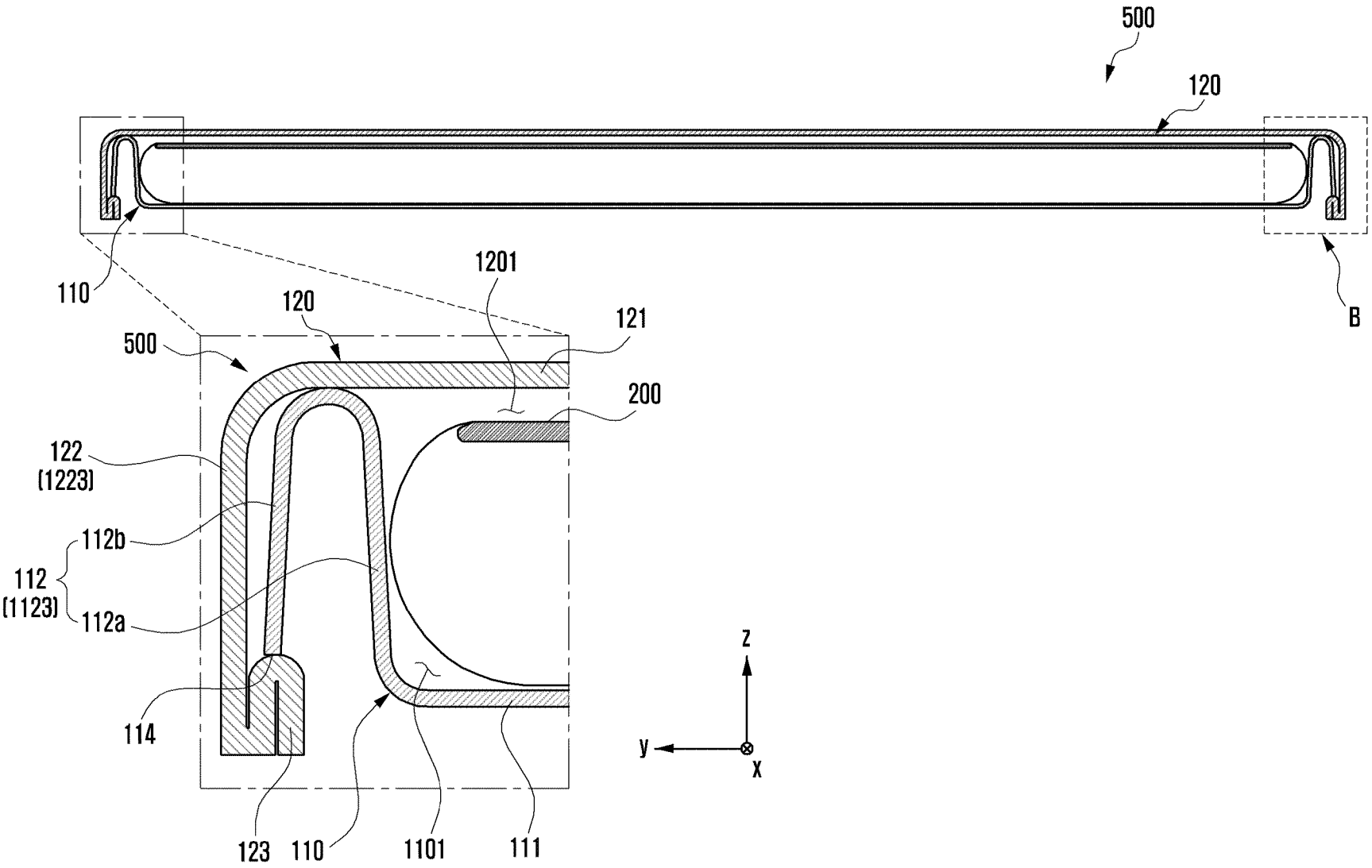
FIG. 11B is a cross-sectional view of a package box assembly taken along line 11*b*-11*b* of FIG. 10A according to various embodiments.
Figure 11C:
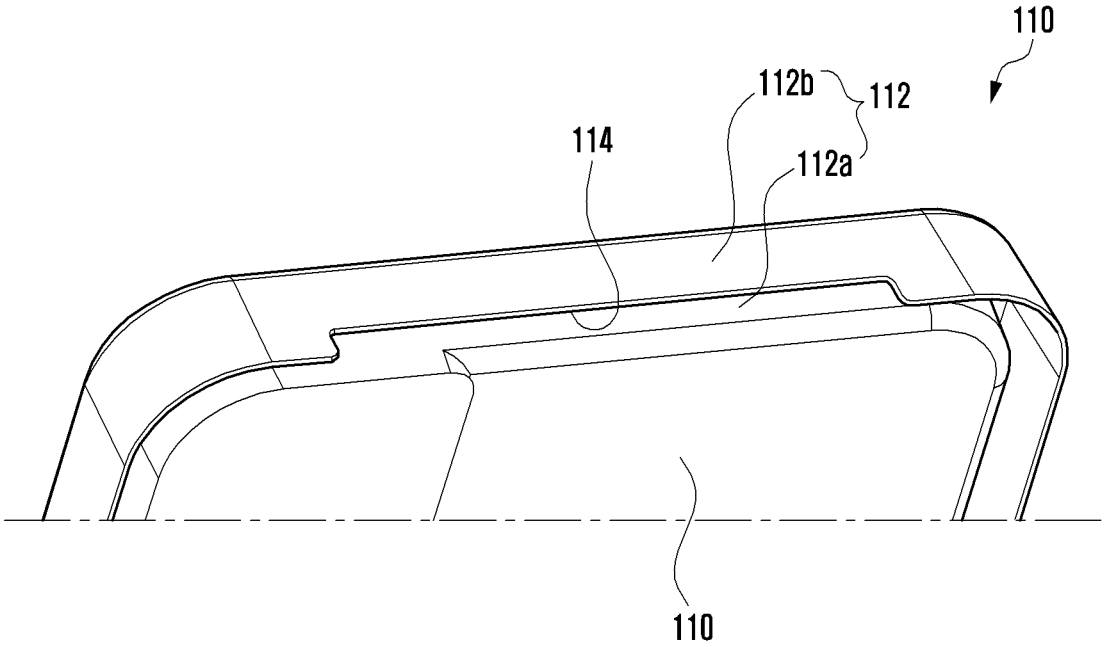
FIG. 11C is a partial perspective view illustrating a portion of a first box according to various embodiments.
Figure 11D:
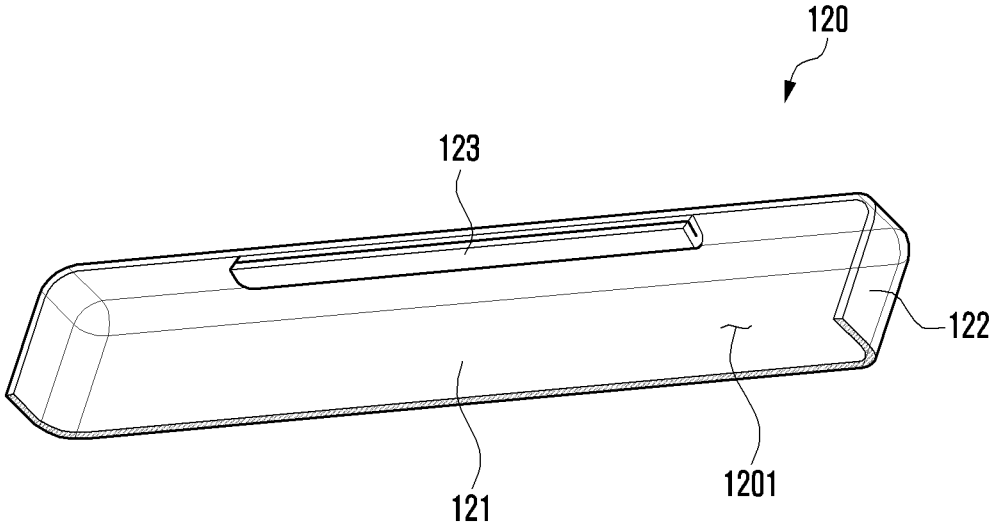
FIG. 11D is a partial perspective view of a portion of a second box according to various embodiments.

FIG. 10A is a perspective view of a package box assembly according to various embodiments. FIG. 10B is an exploded perspective view of a package box assembly according to various embodiments. FIG. 11A is a cross-sectional view of a package box assembly taken along line 11*a*-11*a* of FIG. 10A according to various embodiments. FIG. 11B is a cross-sectional view of a package box assembly taken along line 11*b*-11*b* of FIG. 10A according to various embodiments. FIG. 11C is a perspective view of a portion of a first box according to various embodiments. FIG. 11D is a perspective view of a portion of a second box according to various embodiments.

In describing the package box assembly 500 of FIGS. 10A, 10B, 11A, 11B, 11C and 11D (which may be referred to as FIGS. 10A to 11D), the same reference numerals are given to components that are substantially the same as those of the package box assembly 100 of FIGS. 1A to 3B, and a detailed description thereof may not be repeated here.

With reference to FIGS. 10A to 11D, the package box assembly 500 may include a first box 110 including a first accommodation portion 1101 for accommodating an electronic device 200, and a second box 120 including a second accommodation portion 1201 formed to seal the electronic device 200 by being combined with the first box 110 and enclose at least a part of the first box 110.

According to various embodiments, the package box assembly 500 may include at least one hooking structure for preventing and/or reducing the second box 120 from being arbitrarily separated from the first box 110 when the first box 110 and the second box 120 are assembled. According to an embodiment, the at least one hooking structure may include at least one hooking portion 123 protrudingly formed on at least a part of the inner surface of the second box 120, and at least one hooking step 114 formed on at least a part of the first sidewall 112 of the first box 110 to correspond to the at least one hooking portion 123 and allow the at least one hooking portion 123 to be hooked. According to an embodiment, the at least one hooking step 114 may have a stepped region formed lower than the edge on an outer wall 112*b* of the first sidewall 112. According to an embodiment, the hooking structure may be formed on opposite sides of the first and second sidewalls 112 and 122. For example, at least one hooking structure may include a pair of hooking structures respectively disposed on the opposite first and fifth side surfaces 1121 and 1221 and the opposite third and seventh side surfaces 1123 and 1223. In various embodiments, the at least one hooking structure may include a pair of hooking structures respectively disposed on the second and sixth side surfaces 1122 and 1222 and the fourth and eighth side surfaces 1124 and 1224. In various embodiments, the at least one hooking structure may include four pairs of hooking structures respectively disposed on the first and fifth side surfaces 1121 and 1221, the second and sixth side surfaces 1122 and 1222, the third and seventh side surfaces 1123 and 1223, and the fourth and eighth side surfaces 1124 and 1224.

Figure 12:
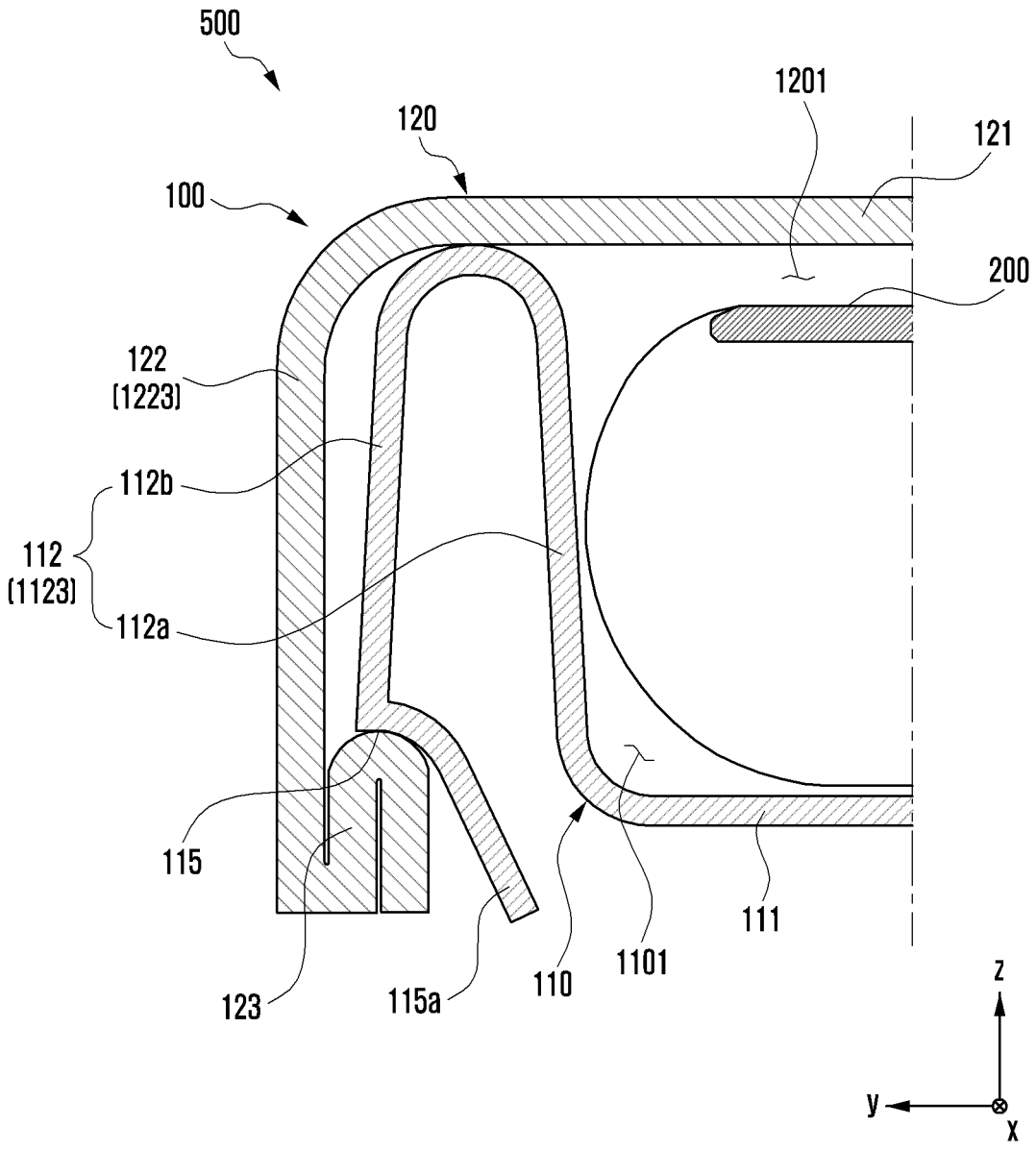
FIG. 12 is a partial cross-sectional view of a portion of a package box assembly including a hooking structure according to various embodiments.

FIG. 12 is a partial cross-sectional view of a portion of a package box assembly including a hooking structure according to various embodiments.

In describing the package box assembly 500 of FIG. 12, the same reference numerals are given to components that are substantially the same as those of the package box assembly 500 of FIG. 11B, and a detailed description thereof may not be repeated here.

With reference to FIG. 12, the package box assembly 500 may include a hooking step 115 formed on an outer wall 112*b* of a first sidewall 112 of a first box 110 and a hooking portion 123 formed on a second sidewall 122 of a second box 120 to be hooked onto the hooking step 115 when the first box 110 and the second box 120 are combined. According to an embodiment, the package box assembly 500 may include an extension 115*a* extended from the hooking step 115. According to an embodiment, the extension 115*a* may be formed integrally with the outer wall 112*b* of the first sidewall 112. For example, the hooking step 115 is formed in a concave shape through shape deformation of at least a part of the outer wall 112*b*, and the extension 115*a* extends from the hooking step 115 into a space between the outer wall 112*b* and the inner wall 112*a*, thereby inducing an easy operation for the user to separate the second box 120 from the first box 110.

According to various example embodiments, a package box assembly (e.g., the package box assembly 100 in FIG. 3B) may include: a first box (e.g., the first box 110 in FIG. 3B) including a first plate portion (e.g., the first plate portion 111 in FIG. 3B) and a first accommodation portion (e.g., the first accommodation portion 1101 in FIG. 3B) formed through a first sidewall (e.g., the first sidewall 112 in FIG. 3B) extending to a designated height along edges of the first plate portion; a second box (e.g., the second box 120 in FIG. 3B) including a second plate portion (e.g., the second plate portion 121 in FIG. 3B) and a second accommodation portion (e.g., the second accommodation portion 1201 in FIG. 3B) formed through a second sidewall (e.g., the second sidewall 122 in FIG. 3B) extending to a designated height along edges of the second plate portion, the second box configured to beat least partially accommodated in the first accommodation portion; a cover member comprising a cover (e.g., the cover member 130 in FIG. 3B) configured to cover a rear surface of the package box assembly based on the first box and the second box being combined; and a hooking structure including a hook configured to fix the cover member to the second box. The hooking structure may include at least one hooking portion (e.g., the hooking portion 131 in FIG. 3B) formed on at least a part of the cover member, and at least one hooking groove (e.g., the hooking groove 122*a* in FIG. 3B) formed to accommodate the hooking portion at a corresponding position of the second box.

According to various example embodiments, one end of the cover member may be bendably fixable to a part of the sidewall of the first box, and an other end may have the at least one hooking portion formed therein.

According to various example embodiments, the at least one hooking groove may include a hooking groove formed at a corresponding position on the second sidewall and configured to accommodate at least a part of the hooking portion.

According to various example embodiments, an extension extending from the hooking portion and detachably attached to a rear surface of the cover member may be included.

According to various example embodiments, an extension extending from the hooking portion, penetrating through the hooking groove, and detachably attached to a rear surface of the cover member may be included.

According to various example embodiments, at least a part of the cover member may extend bendably from at least a part of the second sidewall of the second box.

According to various example embodiments, the second accommodation portion may be configured to accommodate an electronic device.

According to various example embodiments, at least one of the first box, the second box or the cover member may comprise an environmentally friendly pulp material.

According to various example embodiments, the first sidewall may include an inner wall extending along the edges of the first plate portion and an outer wall bent from the inner wall and facing at least a part of the inner wall.

According to various example embodiments, the outer wall may be extended with a wider gap from the inner wall as the outer wall is farther away from a bent point.

According to various example embodiments, the at least one hooking portion may include a first hooking portion configured to be hooked into a first hooking groove formed at a corresponding position of the second sidewall at one end of the cover member, and a second hooking portion configured to be hooked into a second hooking groove formed at a corresponding position of the second sidewall at other end of the cover member.

According to various example embodiments, the at least one hooking portion may comprise a laminated paper in which a part of the cover member made of paper material is folded multiple times.

According to various example embodiments, a package box assembly (e.g., the package box assembly 500 in FIG. 11B) may include: a first box (e.g., the first box 110 in FIG. 11B) including a first plate portion (e.g., the first plate portion 111 in FIG. 11B) and a first accommodation portion (e.g., the first accommodation portion 1101 in FIG. 11B) formed through a first sidewall (e.g., the first sidewall 112 in FIG. 11B) extending to a designated height along edges of the first plate portion; a second box (e.g., the second box 120 in FIG. 11B) including a second plate portion (e.g., the second plate portion 121 in FIG. 11B) and a second accommodation portion (e.g., the second accommodation portion 1201 in FIG. 11B) formed through a second sidewall (e.g., the second sidewall 122 in FIG. 11B) extending to a designated height along edges of the second plate portion, the second box configured to beat least partially accommodated in the first accommodation portion; and a hooking structure including a hook configured to maintain a combined state of the first box and the second box. The hooking structure may include at least one hooking portion (e.g., the hooking portion 123 in FIG. 11B) formed on the second sidewall of the second box, and at least one hooking step (e.g., the hooking step 114 in FIG. 11B) configured to hook the hooking portion at a corresponding position of the first box.

According to various example embodiments, the at least one hooking portion may be arranged on an inner surface of the second side and be configured to be hooked onto at least one hooking step arranged at a corresponding position of the second sidewall.

According to various example embodiments, the at least one hooking portion may comprise a laminated paper in which a part of the second sidewall of the second box comprising a paper material is folded multiple times after extending.

According to various example embodiments, the first sidewall may include an inner wall extending along the edges of the first plate portion and an outer wall bent from the inner wall and facing at least a part of the inner wall.

According to various example embodiments, the at least one hooking step may be formed on at least a part of the outer wall.

According to various example embodiments, the outer wall may be extended with a wider gap from the inner wall as the outer wall is farther away from a bent point.

According to various example embodiments, the at least one hooking step may be deformed into a concave shape and configured to hook at least a part of the outer wall.

According to various example embodiments, an extension extending from the hooking portion and used as a handle for separating the first box and the second box may be further included.

Meanwhile, the various example embodiments disclosed herein and in the drawings are only presented as specific examples to easily explain the technical contents of the disclosure and help the understanding of the disclosure, and it is not intended to limit the scope of the disclosure. Accordingly, it should be understood that all changes or modifications derived from the subject matter of the disclosure are included in the scope of various embodiments of the disclosure including the appended claims and their equivalents. It will also be understood that any of the embodiment(s) described herein may be used in conjunction with any other embodiment(s) described herein.

What is claimed is:

1. A package box assembly comprising:

a first box including a first plate portion and a first accommodation space formed through a first sidewall extending to a designated height along edges of the first plate portion;

a second box including a second plate portion and a second accommodation space formed through a second sidewall extending to a designated height along edges of the second plate portion, the second box configured to be at least partially accommodated in the first accommodation space;

a cover configured to cover a rear surface of the package box assembly based on the first box and the second box being combined; and a hook structure configured to fix the cover to the second box, wherein the hook structure includes:

at least one hook formed on at least a part of the cover;

an extension extending from the at least one hook; and at least one hook groove configured to accommodate the at least one hook at a corresponding position of the second box, and wherein the extension extends through the at least one hook groove and is bent around a portion of the second box for securing to a rear surface of the cover.

2. The package box assembly of claim 1, wherein a first end of the cover is bendably fixed to a part of the first sidewall of the first box, and a second end of the cover comprises the at least one hook.

3. The package box assembly of claim 2, wherein the at least one hook groove includes a hook groove formed at a corresponding position on the second sidewall and configured to accommodate at least a part of the at least one hook portion.

4. The package box assembly of claim 3, wherein the extension is detachably attached to the cover.

5. The package box assembly of claim 1, wherein at least a part of the cover extends bendably from at least a part of the second sidewall of the second box.

6. The package box assembly of claim 1, wherein the second accommodation space is configured to accommodate an electronic device.

7. The package box assembly of claim 1, wherein at least one of the first box, the second box or the cover comprise a pulp material.

8. The package box assembly of claim 1, wherein the first sidewall includes an inner wall extending along the edges of the first plate portion and an outer wall bent from the inner wall and facing at least a part of the inner wall.

9. The package box assembly of claim 8, wherein a gap between the inner wall and the outer wall widens with distance from a bent point between the inner wall and the outer wall.

10. The package box assembly of claim 1, wherein the at least one hook includes:

a first hook configured to be hooked into a first hook groove formed at a corresponding position of the second sidewall at a first end of the cover; and a second hook configured to be hooked into a second hook groove formed at a corresponding position of the second sidewall at a second end of the cover.

11. The package box assembly of claim 10, wherein the at least one hook portion comprises laminated paper in which a part of the cover comprising paper material is folded multiple times.

* * * * *